US011377835B2

(12) United States Patent
Mailhot et al.

(10) Patent No.: US 11,377,835 B2
(45) Date of Patent: Jul. 5, 2022

(54) END CAPS FOR STORMWATER CHAMBERS AND METHODS OF MAKING SAME

(71) Applicant: Advanced Drainage Systems Inc., Hilliard, OH (US)

(72) Inventors: David James Mailhot, York, ME (US); Michael David Kuehn, Higganum, CT (US); Ronald R. Vitarelli, Marlborough, CT (US); Bryan A. Coppes, Old Saybrook, CT (US)

(73) Assignee: Advanced Drainage Systems, Inc., Hilliard, OH (US)

( * ) Notice: Subject to any disclaimer, the term of this patent is extended or adjusted under 35 U.S.C. 154(b) by 0 days.

(21) Appl. No.: 16/525,559

(22) Filed: Jul. 29, 2019

(65) Prior Publication Data

US 2020/0032499 A1 Jan. 30, 2020

Related U.S. Application Data

(60) Provisional application No. 62/711,373, filed on Jul. 27, 2018.

(51) Int. Cl.

| | |
|---|---|
| ***B65G 5/00*** | (2006.01) |
| ***E02B 11/00*** | (2006.01) |
| ***E03F 1/00*** | (2006.01) |

(52) U.S. Cl.

CPC ..... *E03F 1/00* (2013.01)

(58) Field of Classification Search

CPC ..... E02B 11/005; E03F 1/003; E03F 1/002; E03F 1/005; E03F 5/101; E03F 1/00; B65G 5/00

USPC ..... 405/124–126; 285/284.1

See application file for complete search history.

(56) References Cited

U.S. PATENT DOCUMENTS

| | | | | |
|---|---|---|---|---|
| 980,442 A * | 1/1911 | Schlafly | E03F 1/003 138/159 |
| 4,245,924 A * | 1/1981 | Fouss | B29D 23/18 138/119 |
| 4,246,936 A * | 1/1981 | Luz | A01G 25/02 239/145 |

(Continued)

FOREIGN PATENT DOCUMENTS

| | | |
|---|---|---|
| EP | 0 780 524 A1 | 6/1997 |
| EP | 2 884 015 A1 | 6/2015 |
| EP | 2 902 555 A1 | 8/2015 |

OTHER PUBLICATIONS

International Search Report (PCTUS2019/043972)—13 pages.

*Primary Examiner* — Edwin J Toledo-Duran

(74) *Attorney, Agent, or Firm* — Finnegan, Henderson, Farabow, Garrett & Dunner LLC

(57) ABSTRACT

A disclosed corrugated end cap includes a corrugated frame having one or more corrugations defined by one or more sets of alternating peaks and valleys. The end cap also includes one or more ribs disposed in one or more of the valleys and one or more valley reinforcements disposed in the valleys and running over a top surface of the corrugated frame. For example, the one or more ribs may be configured to increase a resistance of the frame to bending. Additionally or alternatively, the top surface, a front surface, and a rear of the corrugated frame surround a recess configured to receive latch ridges from a stormwater chamber.

21 Claims, 15 Drawing Sheets

(56) References Cited

U.S. PATENT DOCUMENTS 4,359,167 A * 11/1982 Fouss ..... B65D 88/04 220/675
4,523,613 A * 6/1985 Fouss ..... E03F 1/003 138/121
4,759,661 A * 7/1988 Nichols ..... E03F 1/003 405/48
4,824,287 A * 4/1989 Tracy ..... E03F 1/002 405/36
5,017,041 A * 5/1991 Nichols ..... E02B 13/00 403/345
5,065,554 A * 11/1991 Neva ..... E04H 9/10 52/80.1
5,087,151 A * 2/1992 DiTullio ..... E03F 1/003 405/48
5,129,758 A * 7/1992 Lindstrom ..... A01G 25/06 239/533.13
5,156,488 A * 10/1992 Nichols ..... E02B 13/00 403/345
5,336,017 A * 8/1994 Nichols ..... E02B 13/00 405/50
5,401,459 A * 3/1995 Nichols ..... B29C 45/1704 264/328.13
5,419,838 A * 5/1995 DiTullio ..... H02G 9/10 210/791
5,441,363 A * 8/1995 Gray ..... E03F 1/003 138/173
5,498,104 A * 3/1996 Gray ..... E03F 1/003 403/364
5,511,903 A * 4/1996 Nichols ..... E03F 1/003 405/36
5,556,231 A * 9/1996 Sidaway ..... E03F 1/003 405/48
5,588,778 A * 12/1996 Nichols ..... E03F 1/003 405/48
5,890,837 A * 4/1999 Wells ..... E03F 3/04 405/36
5,890,838 A * 4/1999 Moore, Jr. ..... E03F 1/003 405/49
6,076,993 A * 6/2000 Gray ..... E03F 1/003 405/43
6,270,287 B1 * 8/2001 Gray ..... E03F 1/003 138/120
6,350,374 B1 * 2/2002 Stever ..... B01D 21/02 210/170.03
6,361,248 B1 * 3/2002 Maestro ..... E03F 1/003 405/48
D477,381 S * 7/2003 Benecke ..... D23/207
6,602,023 B2 * 8/2003 Crescenzi ..... E03F 1/003 405/48
6,612,777 B2 * 9/2003 Maestro ..... E03F 1/003 405/48
6,698,975 B1 * 3/2004 Benecke ..... E03F 1/003 405/49
6,991,734 B1 * 1/2006 Smith ..... E03F 1/002 210/170.03
7,008,138 B2 * 3/2006 Burnes ..... E03F 1/003 405/46
7,052,209 B1 * 5/2006 Kruger ..... E03F 1/003 405/125
7,118,306 B2 * 10/2006 Kruger ..... E03F 1/003 405/126
7,134,808 B2 * 11/2006 Albone ..... E01C 11/227 405/36
D537,912 S * 3/2007 Benecke ..... D23/207
7,189,027 B2 * 3/2007 Brochu ..... E03F 1/003 138/105
7,217,063 B2 * 5/2007 Moore, Jr. ..... E03F 1/003 405/49
7,226,241 B2 * 6/2007 DiTullio ..... E03F 1/003 405/49
7,237,981 B1 * 7/2007 Vitarelli ..... E03F 1/003 210/170.03
D549,836 S * 8/2007 Desbiens ..... D25/19
7,300,226 B1 * 11/2007 Maestro ..... E03F 1/003 405/49
7,306,399 B1 * 12/2007 Smith ..... E03F 1/003 405/40
D566,852 S * 4/2008 Gaster ..... D25/1
7,351,005 B2 * 4/2008 Potts ..... E03F 1/002 405/44
7,364,384 B1 * 4/2008 Swistak ..... E03F 1/003 405/44
7,384,212 B2 * 6/2008 Currivan ..... E03F 11/00 405/45
7,419,332 B1 * 9/2008 Brochu ..... E02B 11/005 405/49
7,473,053 B1 * 1/2009 Brochu ..... E02D 13/00 405/49
7,500,805 B1 * 3/2009 Brochu ..... E03F 1/003 138/105
7,517,172 B2 * 4/2009 Sipaila ..... E03F 1/003 405/36
7,611,306 B1 * 11/2009 Hallahan ..... E03F 1/003 405/49
7,614,825 B2 * 11/2009 Kroger ..... B65D 90/24 405/114
7,628,566 B2 * 12/2009 Miskovich ..... E03F 1/003 405/49
7,798,747 B1 * 9/2010 de Bruijn ..... E03F 1/003 405/125
7,806,627 B2 * 10/2010 DiTullio ..... E03F 1/003 405/49
7,887,256 B2 * 2/2011 Miskovich ..... E03F 1/003 405/51
7,914,231 B2 * 3/2011 Coppes ..... E03F 1/003 405/45
D638,094 S * 5/2011 DiTullio ..... D23/207
D638,095 S * 5/2011 DiTullio ..... D23/207
8,007,201 B2 * 8/2011 Currivan ..... E03F 1/005 405/45
D653,352 S * 1/2012 Jacques ..... D25/18
8,147,688 B2 * 4/2012 Adams ..... E03F 1/002 210/170.03
8,366,346 B2 * 2/2013 DiTullio ..... E03F 1/003 405/43
8,414,222 B2 * 4/2013 DiTullio ..... E03F 1/003 405/46
8,425,148 B2 * 4/2013 DiTullio ..... E03F 1/003 405/49
8,491,224 B2 * 7/2013 Cobb ..... E02B 11/005 405/49
8,636,444 B2 * 1/2014 Currivan ..... E03F 1/002 405/45
8,672,583 B1 * 3/2014 Mailhot ..... E02B 11/005 405/42
8,858,119 B2 * 10/2014 Wynne ..... E03F 1/003 405/44
8,955,258 B2 * 2/2015 Jacques ..... E04B 1/34357 52/2.18
D728,825 S * 5/2015 Miskovich ..... D25/36
9,290,924 B2 * 3/2016 Wynne ..... E03F 1/003
9,556,576 B2 * 1/2017 Mailhot ..... E03F 1/003
9,580,898 B2 * 2/2017 Wynne ..... E03F 1/002
9,637,907 B2 * 5/2017 Mailhot ..... E02B 11/00
9,765,509 B1 * 9/2017 DiTullio ..... B29C 44/02
9,809,968 B1 * 11/2017 Holbrook ..... E03F 1/003
D806,827 S * 1/2018 Mailhot ..... D23/207
D840,499 S * 2/2019 DiTullio ..... D23/206
2002/0025226 A1 * 2/2002 Maestro ..... E03F 1/003 405/43
2002/0044833 A1 * 4/2002 Kruger ..... E03F 1/003 405/43
2003/0095838 A1 * 5/2003 Maestro ..... E03F 1/003 405/39
2003/0228194 A1 12/2003 Ring
2004/0184884 A1 * 9/2004 DiTullio ..... E03F 1/003 138/121

(56) References Cited

U.S. PATENT DOCUMENTS

| | | | | |
|---|---|---|---|---|
| 2005/0074285 | A1* | 4/2005 | Burnes | E03F 1/003<br>210/170.03 |
| 2005/0074287 | A1* | 4/2005 | Brochu | E03F 1/003<br>405/48 |
| 2005/0074288 | A1* | 4/2005 | Moore | E03F 1/003<br>405/46 |
| 2005/0111915 | A1* | 5/2005 | Moore | E03F 1/003<br>405/49 |
| 2005/0238434 | A1* | 10/2005 | Coppes | E03F 1/003<br>405/36 |
| 2007/0258770 | A1* | 11/2007 | Miskovich | E03F 1/003<br>405/43 |
| 2008/0181725 | A1* | 7/2008 | Miskovich | E03F 1/003<br>405/49 |
| 2008/0226394 | A1* | 9/2008 | Coppes | E03F 1/003<br>405/49 |
| 2008/0240859 | A1* | 10/2008 | Sipaila | E03F 1/003<br>405/49 |
| 2009/0220302 | A1* | 9/2009 | Cobb | E03F 1/003<br>405/49 |
| 2010/0059430 | A1* | 3/2010 | Adams | E03F 1/002<br>210/170.03 |
| 2015/0211198 | A1* | 7/2015 | Mailhot | E03F 1/003<br>405/49 |
| 2017/0089054 | A1 | 3/2017 | Mailhot | |

* cited by examiner

END CAPS FOR STORMWATER CHAMBERS AND METHODS OF MAKING SAME

CROSS-REFERENCE TO RELATED APPLICATIONS

This application claims the benefit of U.S. Provisional Application Ser. No. 62/711,373, filed Jul. 27, 2018, the contents of which are herein incorporated by reference in their entirety.

TECHNICAL FIELD

The disclosure relates generally to stormwater systems, and more particularly, to end caps for stormwater chambers and methods for making end caps for stormwater chambers.

BACKGROUND

Stormwater management systems are used to manage and control stormwater, for example, by providing stormwater chambers for retention or detention of stormwater. As such, stormwater chambers may be provided underground where the chambers capture, filter, and/or contain the stormwater until it is deposited in the ground or an off-site location. Such systems, often buried underground, are subject to the stresses and strains imparted by surrounding layers of soil, gravel, and other materials. Further, wheel loads and track loads from heavy equipment during construction may cause stresses and strains on the chamber in addition to the stresses and strains from repetitive wheel loads by vehicles operated over the top of the finished site.

The weight of these surrounding layers exacerbated by the live loads described above may negatively affect the performance of drainage systems by deforming portions of the stormwater chambers, such as one or more end caps. Furthermore, replacing portions of the stormwater chambers, such as the end cap, can be both time consuming and expensive due to the location of the stormwater chambers. Accordingly, a need exists for stormwater systems and methods that address these drawbacks.

SUMMARY

In one embodiment, a corrugated end cap may comprise a corrugated frame comprising one or more corrugations defined by one or more sets of alternating peaks and valleys; one or more ribs disposed in one or more of the valleys and configured to increase a resistance of the frame to bending; and one or more valley reinforcements disposed in the valleys and running over a top surface of the corrugated frame.

In one embodiment, a corrugated end cap may comprise a corrugated frame comprising one or more corrugations defined by one or more sets of alternating peaks and valleys; one or more ribs disposed in one or more of the valleys and configured to increase a resistance of the frame to bending; and one or more valley reinforcements disposed in the valleys and running over a top surface of the corrugated frame. The one or more ribs may be disposed at an angle relative to corresponding one or more of the peaks based on dimensions of a pipe configured to fit into the end cap.

In one embodiment, a corrugated end cap may comprise a corrugated frame comprising one or more corrugations defined by one or more sets of alternating peaks and valleys; one or more ribs disposed in one or more of the valleys; and one or more valley reinforcements disposed in the valleys and running over a top surface of the corrugated frame. The top surface, a front surface, and a rear of the corrugated frame may surround a recess configured to receive latch ridges from a stormwater chamber.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this disclosure, illustrate exemplary embodiments and, together with the description, serve to explain the disclosed principles.

DETAILED DESCRIPTION

As discussed in further detail below, various embodiments of end caps for stormwater chambers are provided. Embodiments of the end cap may include exterior and/or interior ribs to provide improved structural integrity, as compared to traditional designs. In some embodiments, at least one aperture (e.g., hole) is formed in an end cap to provide pipe-access to the interior of a stormwater chamber including a stormwater chamber body and at least one end cap. By providing the exterior and/or interior ribs as part of the end cap, the pipe fitted into the aperture in the end cap may be less likely to be damaged or blocked due to bending of the end cap under the strain of overlying layers of material.

Further, in some embodiments, the end cap may be secured to the chamber body via a fastening system. For example, in one embodiment, the end cap may be secured to the body by disposing teeth on the end cap that are configured to be received in a valley formed at an end of the chamber body. A lie-flat injection molding process may be used in some embodiments to form the end cap as a unitary body, thereby further improving its structural integrity. These and other features of presently contemplated embodiments are discussed in more detail below.

Figure 1A:
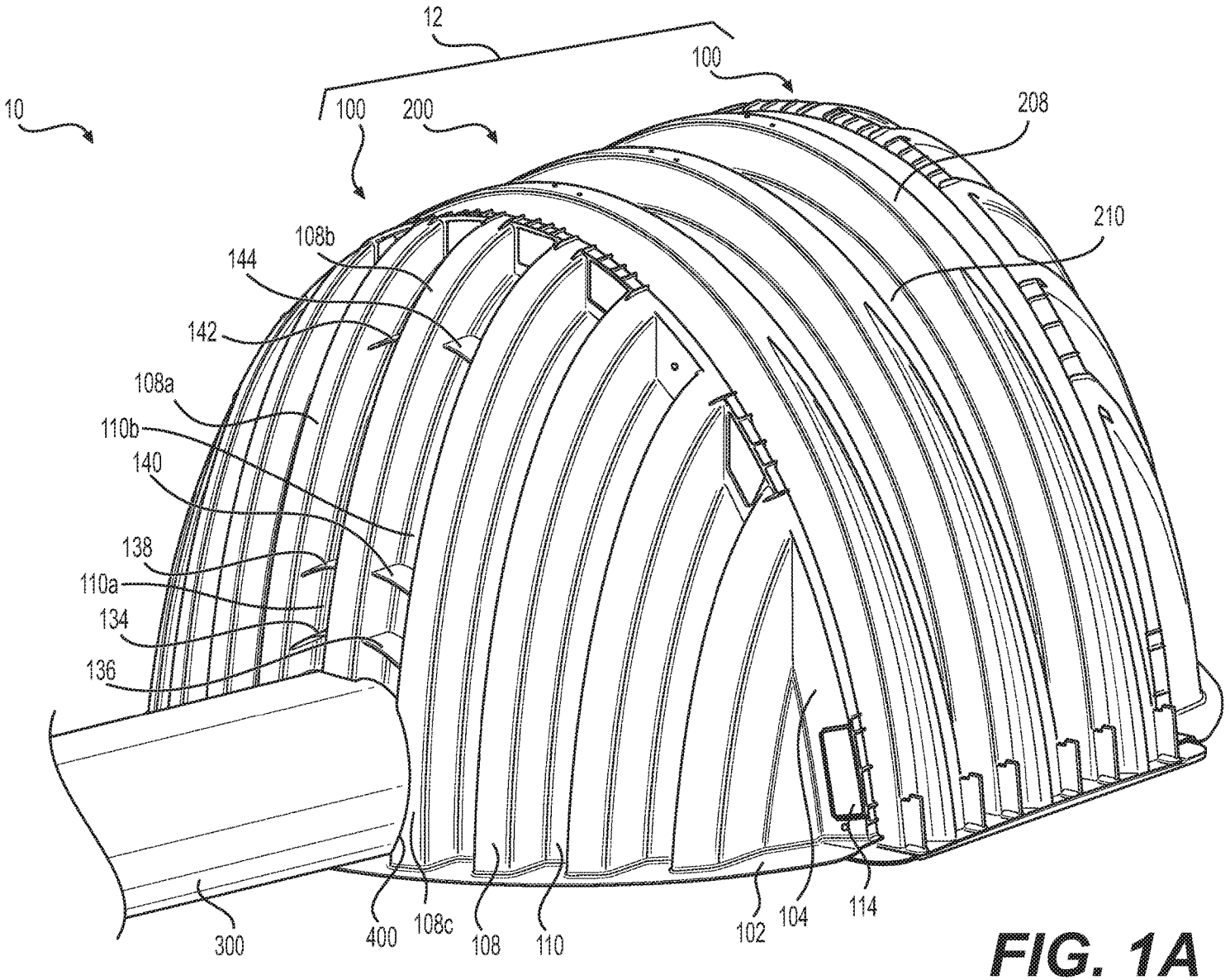
FIG. 1A illustrates a stormwater management system, according to a disclosed embodiment.

Turning now to the drawings, FIG. 1A illustrates an embodiment of a stormwater management system 10 in accordance with one embodiment of the present disclosure. In the illustrated embodiment, the stormwater management system 10 includes a stormwater chamber 12 and a pipe 300. The stormwater chamber 12 includes two end caps 100 affixed to a stormwater chamber body 200. As illustrated in FIG. 1A, during use of the stormwater chamber 12, the pipe 300 is fitted through an aperture (e.g., a hole) 400 formed in one of the end caps 100 of the stormwater chamber 12. FIG. 2A illustrates the stormwater chamber 12 of FIG. 1A with one of the end caps 100 detached from the chamber body 200, and before aperture 400 is formed therein.

As shown in FIG. 2A, ribs 130, 132, 134, 136, 138, 140, 142, and 144 are provided to increase the structural integrity of the end cap 100, as compared to designs without ribs. Moreover, one or more sets of ribs may be provided to enable the end cap 100 to be used with a variety of pipe diameters. For example, in the embodiment shown in FIG. 1A, the ribs 130 and 132 have been cut out because the diameter of the pipe 300 exceeded the diameter that could be accommodated by ribs 130 and 132. However, ribs 134, 136, 138, 140, 142 and 144 remain to provide increased structural integrity, as compared to end caps without ribs.

In some embodiments, the quantity, angle, thickness, or other features of the provided ribs may vary to accommodate pipes of multiple diameters with a single end cap 100. That is, in other embodiments, there may be more or less than four sets of two ribs, or the ribs may be provided as singular ribs, depending on implementation-specific considerations. For further example, in some embodiments, one or more additional ribs may be provided below ribs 130 and 132 to accommodate pipe(s) with a diameter smaller than the pipe 300. A set of ribs may include more than two ribs which may include ribs on the interior of the end cap in addition to the exterior of the end cap. Ribs visible on the exterior of the end cap may be disposed in the valleys. Ribs visible on the inside of the end cap may be under the crests of the exterior or in the valleys of the interior. Further, the additional ribs may be angled to accommodate one or more smaller pipe diameters.

In the stormwater management system of FIG. 1A, during the formation of the aperture 400, the first set of ribs including ribs 130 and 132 were removed. In other embodiments, however, one or more of the other sets of ribs may be removed in the formation of the aperture 400. Other embodiments may use a larger or smaller aperture than that illustrated in FIG. 1A. Furthermore, other embodiments may have the aperture 400 placed at a different position in the end cap 100. For example, aperture 400 need not coincide with base 102. Rather, aperture 400 may be set higher than illustrated in FIG. 1A such that one or more of ribs 130, 132, 134, 136, 138, and 140 are disposed beneath aperture 400 and/or pipe 300.

In the embodiment shown in FIG. 1A, aperture 400 has been formed in one of the end caps 100 such that pipe 300 may be fitted into the stormwater chamber 12 to facilitate the delivery of material to, reception of material from, or transport of material through stormwater chamber 12 via pipe 300. In some embodiments, the diameter of aperture 400 may be slightly larger than that of pipe 300 in order for pipe 300 to fit within aperture 400. In other embodiments, however, the pipe 300 may be secured in aperture 400 by one or more securement devices or fits (e.g., via interference fit). Although both the pipe 300 and aperture 400 are illustrated as having circular profiles, other profiles may be used depending on the desired implementation of the stormwater chamber 12. In other embodiments the aperture 400 and a cross-section of the pipe 300 may be, for example, ovoid, curvilinear, arch-shaped or polygonal. In other embodiments, more than one pipe may be fitted into the end caps 100. In yet other embodiments, at least one pipe is fitted into both end caps 100.

In the embodiment of FIGS. 1 and 2A, the chamber body 200 is corrugated such that the outer surface is contoured and includes a series of corrugations comprising peaks 208 and valleys 210. The chamber corrugations may be disposed along the entire length of the chamber body 200 or along only a portion of the chamber body 200. In other embodiments, the chamber body 200 may not be corrugated. Indeed, in some embodiments, the outer surface of the chamber may be smooth (e.g., without the presence of the peaks 208 and valleys 210) along some or all of the length of the chamber body 200. Further, in some embodiments, the chamber body 200 and/or end cap 100 may be partially smooth and/or partially corrugated, as described in more detail below with respect to FIGS. 7A-F.

In FIG. 1A, the end caps 100 are connected to the chamber body 200 to form the stormwater chamber 12. In the illustrated embodiment, the end caps 100 are corrugated such that the outer surface is contoured and includes a series of end cap corrugations comprising exterior peaks 108 and exterior valleys 110. The exterior peaks 108 and exterior valleys 110 may emanate from base 102 of end cap 100 and terminate on the surface of a frame exterior 104. The corrugations may be disposed along the entire width of end cap 100 or along only a portion of end cap 100. In some embodiments, the corrugations may improve structural integrity of the end caps 100 compared to smooth-surfaced end caps.

In some embodiments, the end cap corrugations may have a pitch defined by exterior peaks 108 and exterior valleys 110. The pitch may be a slope measurement measured between adjacent exterior peaks 108 and/or exterior valleys 110. The pitch may vary depending on the given implementation and may be determined, for example, based on a downstream use of the end cap 100. Further, in other embodiments, the end cap 100 may not be corrugated. Indeed, in some embodiments, the outer surface of the chamber may be smooth (e.g., without the presence of the exterior peaks 108 and exterior valleys 110) along some or all of the end cap 100. In the embodiment of FIGS. 1 and 2A, the exterior peaks 108 and the exterior valleys 110 are of equal width. However, other embodiments may employ greater or lesser width ratios depending on implementation-specific considerations.

Furthermore, in some embodiments, one or more of the ribs 130, 132, 134, 136, 138, 140, 142, and 144 may be disposed partially or fully in one or more of the valleys 110 (e.g., between adjacent exterior peaks 108). For example, in the illustrated embodiment, the ribs 130, 134, 138 and 142 are disposed in exterior valley 110*a*, between exterior peaks 108*a* and 108*b*. Likewise, the ribs 132, 136, 140 and 144 are disposed in exterior valley 110*b* between exterior peaks 108*b* and 108*c*. However, in other embodiments, one or more of the ribs 130, 132, 134, 136, 138, 140, 142, and 144 may be disposed in exterior valleys 110 other than the illustrated exterior valleys 110*a* and 110*b*.

Further, in some embodiments, one or more of the ribs 130, 132, 134, 136, 138, 140, 142, and 144 may be disposed in an exterior valley 110 such that the edge of the respective rib extends outward from the end cap body no farther than the outer wall of the adjacent exterior peaks 108*b* and 108*c*. That is, in some embodiments, one or more of the ribs 130, 132, 134, 136, 138, 140, 142, and 144 may be contained within the exterior valley 110. However, in other embodiments, the amount of extension beyond the outer wall of the adjacent exterior peaks 108*b* and 108*c* may be minimized to reduce or prevent the likelihood of the respective rib bending during use.

Figure 1B:
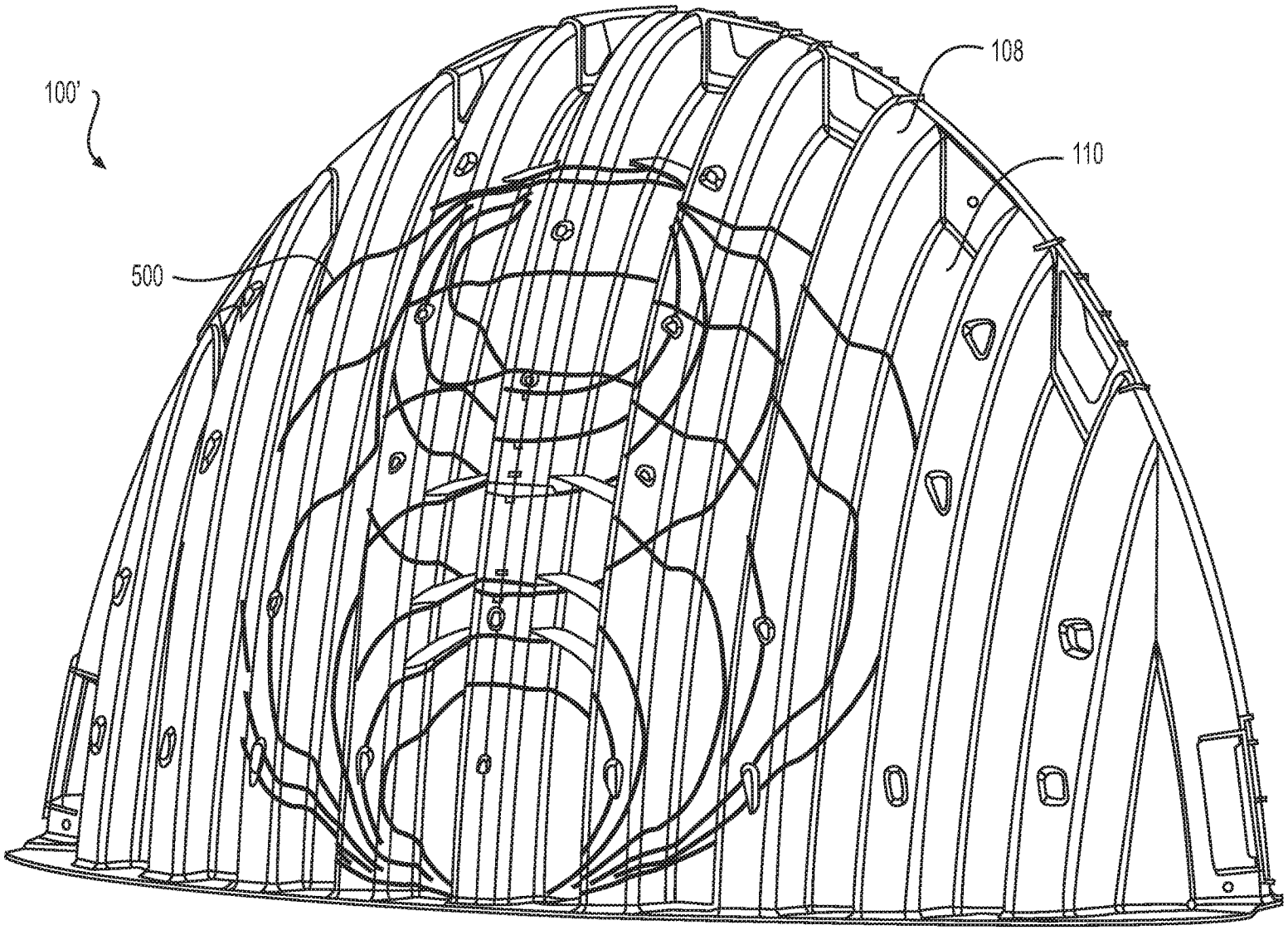
FIG. 1B illustrates an alternative end cap for use in the stormwater management system of FIG. 1A, according to a disclosed embodiment.
Figure 1C:
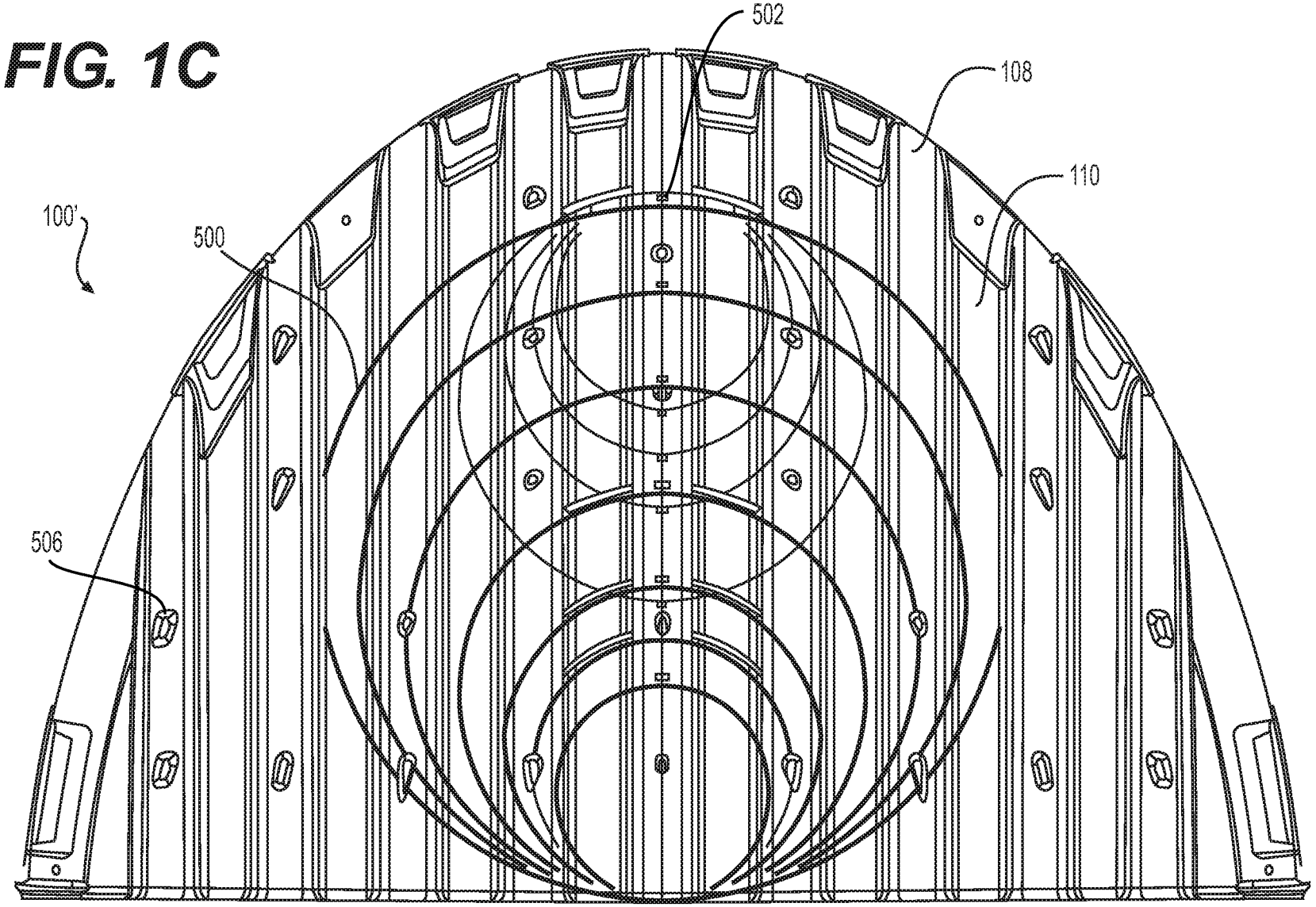
FIG. 1C illustrates an alternative end cap for use in the stormwater management system of FIG. 1A, according to a disclosed embodiment.

FIG. 1B depicts an alternative end cap 100' for use in stormwater management system 10 of FIG. 1A. End cap 100' includes similar elements to end cap 100 of FIG. 1A, but in FIG. 1B, the end cap 100' further includes markings 500 configured to guide one or more potential cutout locations to accommodate the pipe 300. In some embodiments, the markings 500 may be substantially circular when viewed from the front of the end cap. However, the markings 500 may follow the curvature of the corrugated end cap when viewed, for example, as shown in FIG. 1C. The markings 500 may be any type of marking suitable to guide a cutout location. For example, the markings 500 may be a raised surface, indented surface, and/or surface marking applied to the surface of the end cap (e.g., a colored marking).

FIG. 1C illustrates a front view of end cap 100' of FIG. 1B with markings 500. As shown in FIG. 1C, the markings 500 may be provided to match one or more diameters of potential pipes, as described above. To that end, one or more labels 502 may be provided proximate the markings 500 to indicate the pipe size, type, etc. that would be accommodated by a cutout using the associated marking 500. The labels 502 may be any suitable type, such as a numerical indication, alphanumerical indication, surface marking, indentation, raised surface, etc.

In some embodiments, the markings 500 may be disposed at a distance from the proximate ribs (e.g., below the adjacent ribs), as illustrated. The foregoing feature may accommodate potential error that may occur when following the cutout, thus reducing the likelihood that the adjacent ribs are displaced during generation of the cutout. In other embodiments, however, the markings 500 may be provided adjacent the corresponding ribs.

As further depicted in FIG. 1C, some embodiments may additionally or alternatively one or more apertures 504 configured to receive a fastening device (e.g., a screw). Accordingly, in such embodiments, the end cap 100' may be coupled to the chamber body 200 via the finger latches and/or one or more fastening devices inserted into one or more of apertures 504.

As further depicted in FIG. 1C, some embodiments may additionally or alternatively include a plurality of sprues 506. The sprues 506 may correspond to the points where plastic is injected into the mold during formation of the end cap 100'.

Figure 1D:
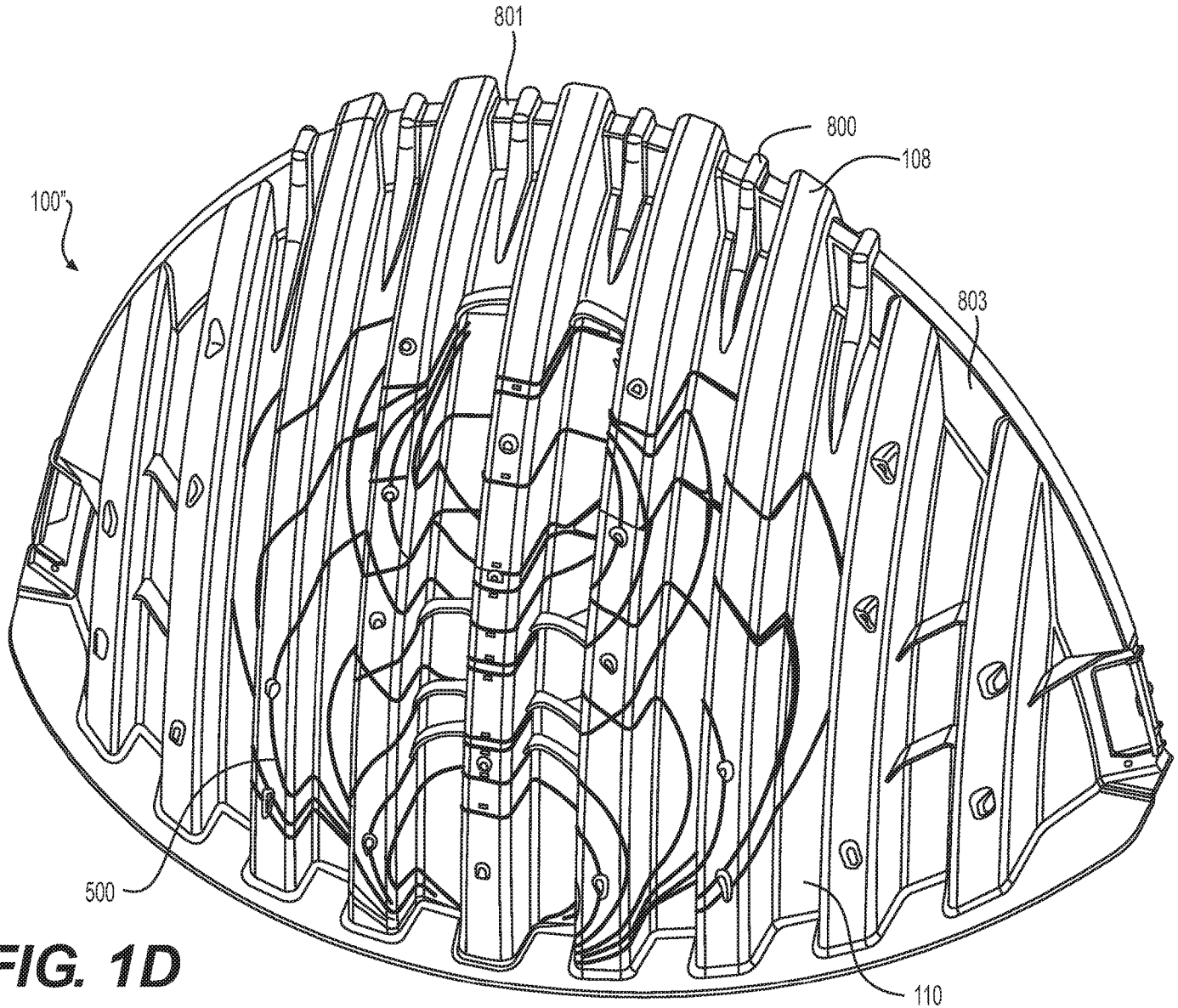
FIG. 1D illustrates an alternative end cap for use in the stormwater management system of FIG. 1A, according to a disclosed embodiment.
Figure 1E:
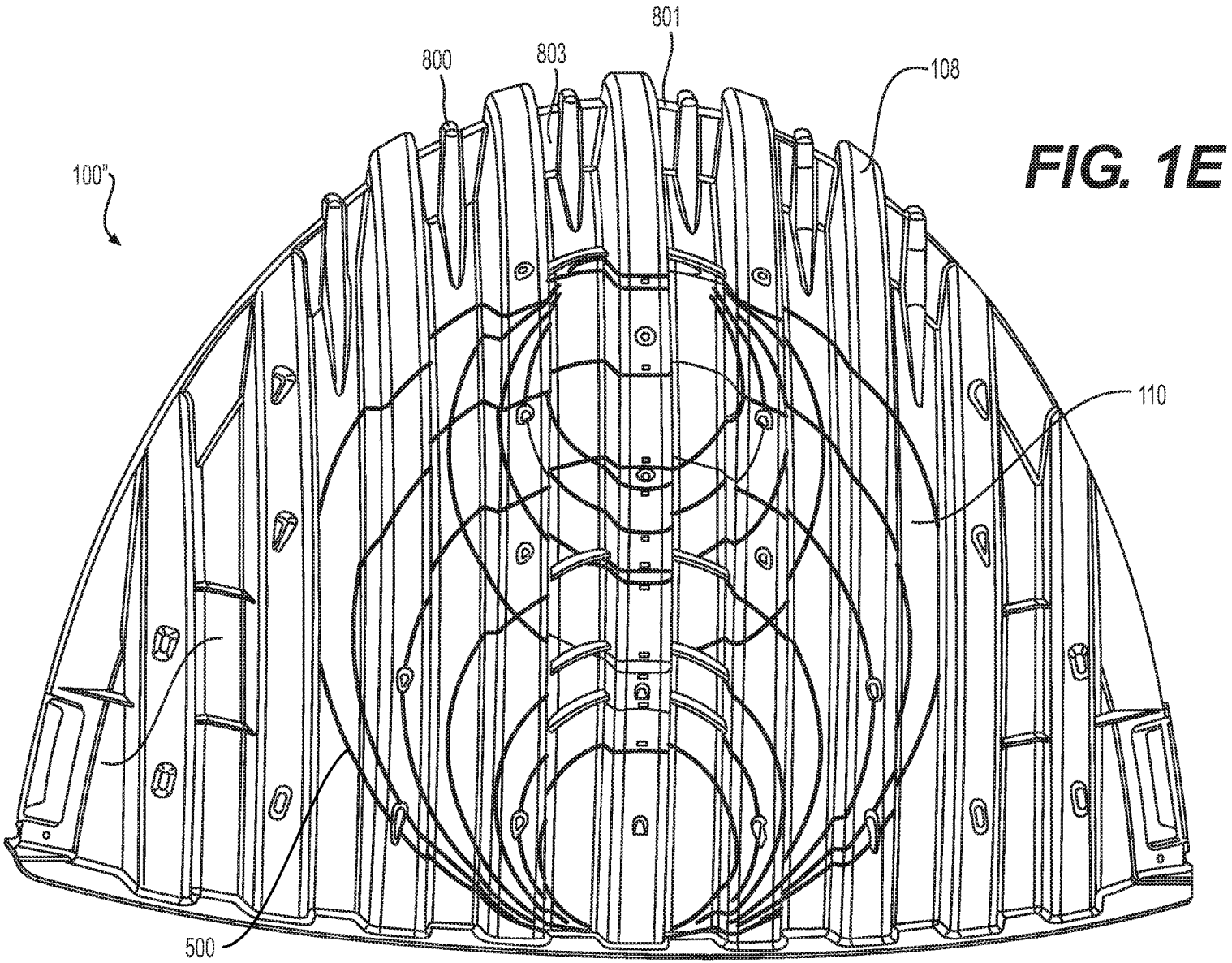
FIG. 1E is a perspective view of the end cap of FIG. 1D, according to a disclosed embodiment.

FIGS. 1D and 1E depict an alternative end cap 100" for use in stormwater management system 10 of FIG. 1A. End cap 100" includes similar elements to end cap 100' of FIGS. 1B and 1C. As depicted in FIG. 1D, end cap 100" further includes valley reinforcements 800. Moreover, in the example of FIG. 1D, valley reinforcements 800 taper along a width and/or a height but may be the same length or different lengths. Although depicted with six valley reinforcements 800 in FIG. 1D, any number of valley reinforcements may be implemented. FIG. 1E depicts an alternative view of FIG. 1D.

As further depicted in FIGS. 1D and 1E, valley reinforcements 800 may extend over a top surface 801 of end cap 100". Moreover, in some embodiments, as further shown in FIG. 4B, valley reinforcements 800 may further extend over a rear surface of end cap 100". Thus, similar to FIG. 1H, described below, the rear surface of end cap 100" may extend around all or part of the frame, e.g., approximately 120 degrees (e.g., 120±2 degrees) around the frame or the like. Accordingly, top surface 801, along with the front surface 803 and the rear surface (not shown) may form a recess configured to receive a latch ridge (e.g., ridge 204 of chamber body 200). By using valley reinforcements 800 to replace teeth 116, end cap 100" may provide a load path from end cap 100" chamber body 200 and places some or all of the load on chamber body 200, reducing or preventing the load on teeth 116. In some embodiments, one or more additional teeth (e.g., teeth 116 as depicted in FIG. 4B) may cooperate with the chamber body 200 to further secure chamber body 200 to end cap 100".

In some embodiments, the features of the end cap 100" illustrated in FIG. 1E could be incorporated into the features of end cap 100, as it is illustrated in FIGS. 1A and 2A, by, for example, including valley reinforcements 800 on or near (e.g., adjacent to, below, or the like) teeth 116 and/or openings 114. Further, in certain embodiments, valley reinforcements 800 may replace the teeth 116 and/or openings 114. Accordingly, the valley reinforcements 800 may be disposed in exterior valleys 110. Moreover, although depicted as including markings 500 similar to end cap 100' of FIG. 1C, other embodiments may include valley reinforcements 800 without markings 500.

Figure 1F:
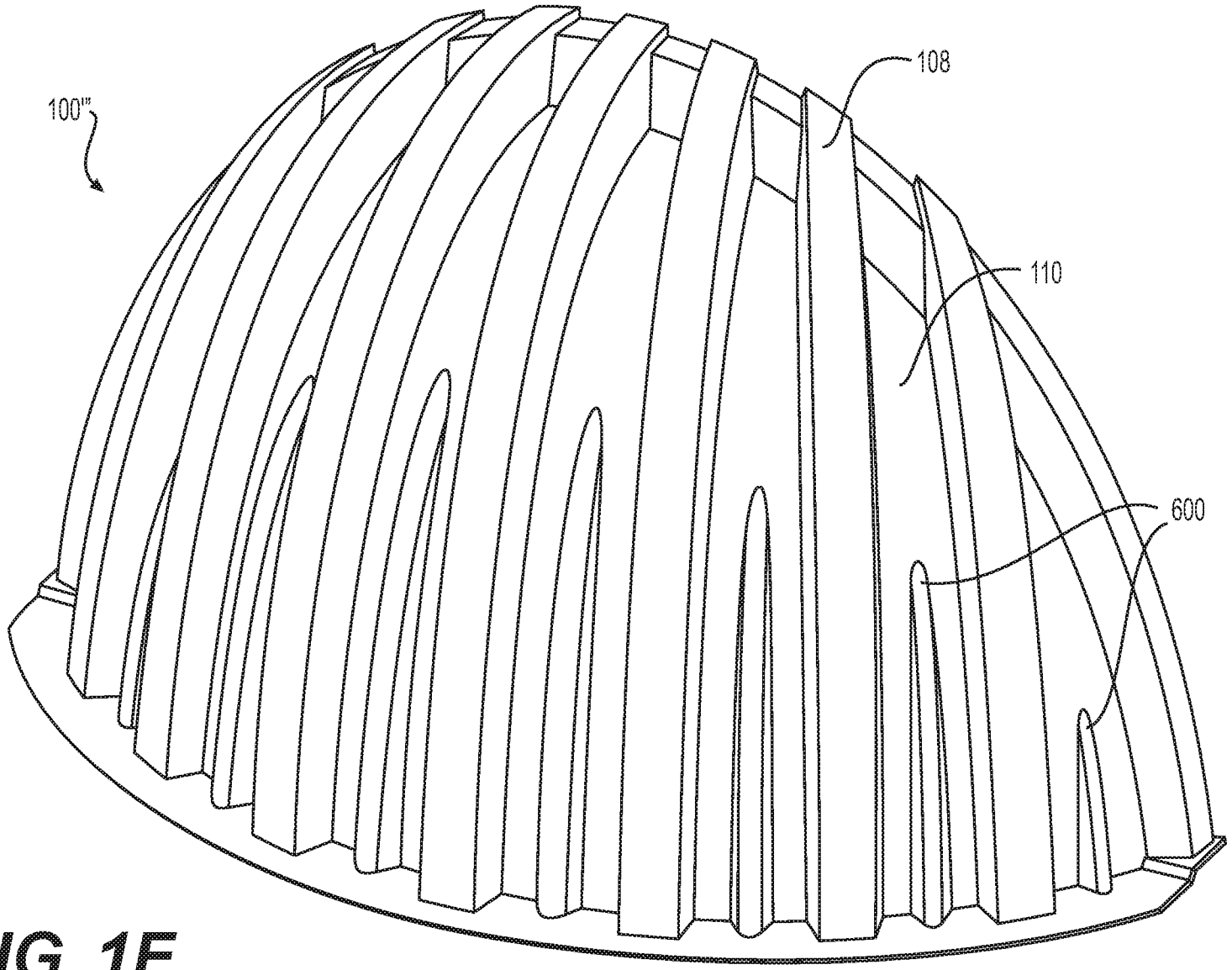
FIG. 1F illustrates an alternative end cap for use in the stormwater management system of FIG. 1A, according to a disclosed embodiment.

FIG. 1F depicts yet another alternative end cap 100'" for use in stormwater management system 10 of FIG. 1A. End cap 100'" includes similar elements to end cap 100 of FIG. 1A. As depicted in FIG. 1F, the end cap 100'" further includes sub-corrugations 600 disposed in exterior valleys 110. Although not depicted in FIG. 1F, one or more additional ribs may be disposed between sub-corrugations 600 and exterior valleys 110 to further re-enforce the frame of end cap 100'".

Each of the sub-corrugation peaks is illustrated in FIG. 1F as oriented toward a same point, resulting in peaks that curve laterally. In some embodiments, the features of the end cap 100' illustrated in FIG. 1F could be incorporated into the features of end cap 100, as it is illustrated in FIGS. 1A and 2A, by, for example, including sub-corrugations 600 in exterior valleys 110 that intersect with the exterior ribs of end cap 100. Moreover, the exterior peaks 108 may be oriented toward the same point, resulting in peaks that curve laterally. Furthermore, in some embodiments, the latching mechanisms, including teeth 116 and openings 114, could be incorporated into the end cap design of FIG. 1F. End cap 100'" may further include, in some embodiments, markings 500 similar to those of end cap 100', valley reinforcements 800 similar to those of end cap 100", or any other features illustrated in FIGS. 1A-1H.

Although not depicted, end cap 100''' may use sub-corrugations 600 to replace one or more of exterior peaks 108 in addition to or in lieu of including sub-corrugations 600 in exterior valleys 110. For example, the outermost exterior peaks 108 of end cap 100' may be replaced with sub-corrugations 600 and the remaining exterior peaks 108 retained. Any other pattern, whether regular or irregular, of exterior peaks 108 may be replaced by sub-corrugations 600.

Figure 1G:
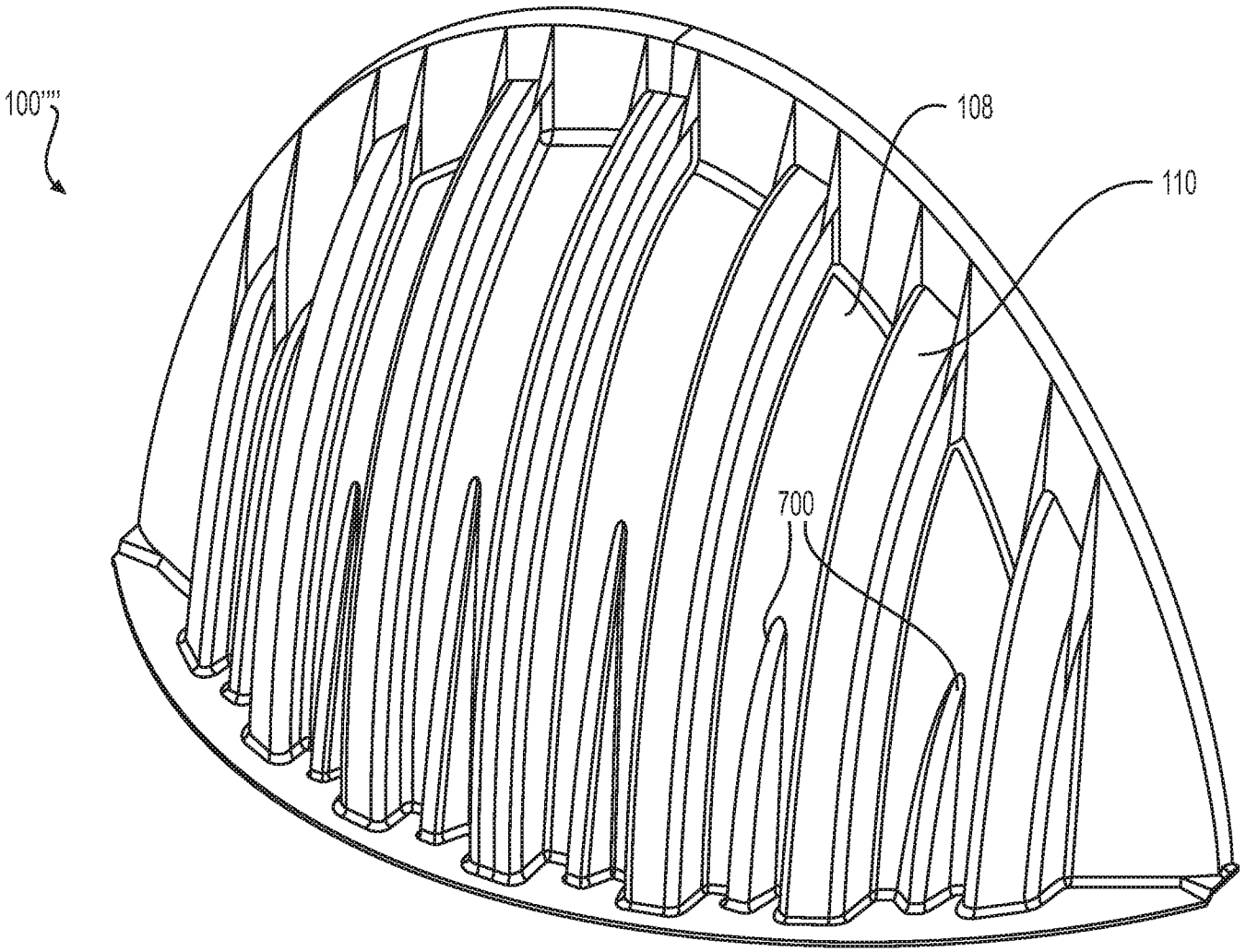
FIG. 1G illustrates an alternative end cap for use in the stormwater management system of FIG. 1A, according to a disclosed embodiment.

FIG. 1G depicts an alternative end cap 100'''' for use in stormwater management system 10 of FIG. 1A. End cap 100'''' includes similar elements to end cap 100 of FIG. 1A. As depicted in FIG. 1G, the end cap 100'''' further includes flat fins 700 disposed in exterior valleys 110. Although not depicted in FIG. 1G, one or more additional ribs may be disposed between flat fins 700 and exterior valleys 110 to further re-enforce the frame of cap 100'''' Moreover, although not depicted in FIG. 10, one or more sub-corrugations 600 of FIG. 1F may be included in addition to or in lieu of flat fins 700. End cap 100'' may further include, in some embodiments, markings 500 similar to those of end cap 100', valley reinforcements 800 similar to those of end cap 100'', or any other features illustrated in FIGS. 1A-1H.

In some embodiments, the features of the end cap illustrated in FIG. 1G could be incorporated into the features of end cap 100, as it is illustrated in FIGS. 1A and 2A, by, for example, including flat fins 700 in exterior valleys 110. Furthermore, in some embodiments, the latching mechanisms, including teeth 116 and openings 114, could be incorporated into the end cap design of FIG. 1G.

As further depicted in FIG. 1G, peaks 110 of end cap 100'''' terminate below a top surface of end cap 100''. Moreover, in the example of FIG. 1G, peaks 110 are oriented parallel to one another. In some embodiments, the features of the end cap 100'''' illustrated in FIG. 1G could be incorporated into the features of end cap 100, as it is illustrated in FIGS. 1A and 2A, by, for example, terminating the exterior peaks 108 below the top surface of the frame 104. Moreover, although depicted as including peaks 110 terminating below a top surface of the end cap along with flat fins 700, other embodiments may include flat fins 700 without peaks 110 terminating below a top surface or peaks 110 terminating below a top surface without flat fins 700.

Figure 1H:
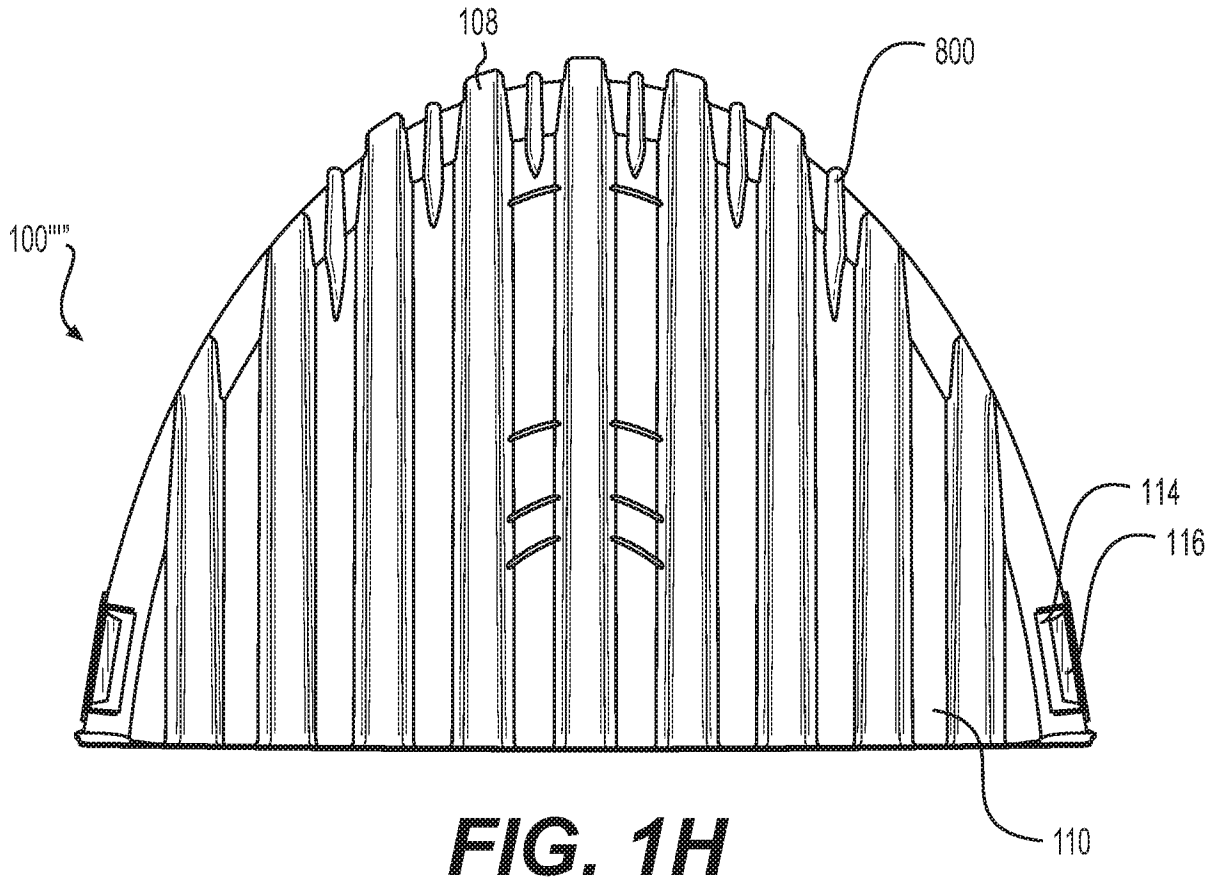
FIG. 1H illustrates an alternative end cap for use in the stormwater management system of FIG. 1A, according to a disclosed embodiment.

FIG. 1H depicts an alternative end cap 100 for use in stormwater management system 10 of FIG. 1A. End cap 100 includes similar elements to end cap 100'' of FIGS. 1D and 1E. As depicted in FIG. 1H, valley reinforcements 800 are disposed down a center axis of the exterior valleys 110 such that the distance from a neighboring exterior peak 108 to one side of the valley reinforcement 800 is equal to the distance from the neighboring exterior peak 108 on the other side of the valley reinforcement 800. However, in other embodiments, one or more of the valley reinforcements 800 may be closer or farther from one of the neighboring peaks 108 compared to the other neighboring exterior peak. In yet other embodiments, there may be more than one exterior sub-corrugation 112 between adjacent exterior peaks 108. As further depicted in FIG. 1H, a plurality of teeth 116 extend from the frame. Each tooth 116 corresponds to an opening 114 in the frame and is configured to cooperate with chamber body 200 to latch chamber body 200 to end cap 100. End cap 100 may further include, in some embodiments, markings 500 similar to those of end cap 100' or any other features illustrated in FIGS. 1A-1G.

Any of the end caps and features thereof depicted in FIGS. 1A-1H may be implemented in an end cap for use in the stormwater chamber 12, consistent with disclosed embodiments. In some embodiments, some or all of the features of the end caps illustrated in one or more of FIGS. 1A-1H may be combined with some or all of the features illustrated in others of FIGS. 1A-1H. Indeed, embodiments consistent with the present disclosure are not limited to the particular combinations illustrated herein.

Figure 2B:
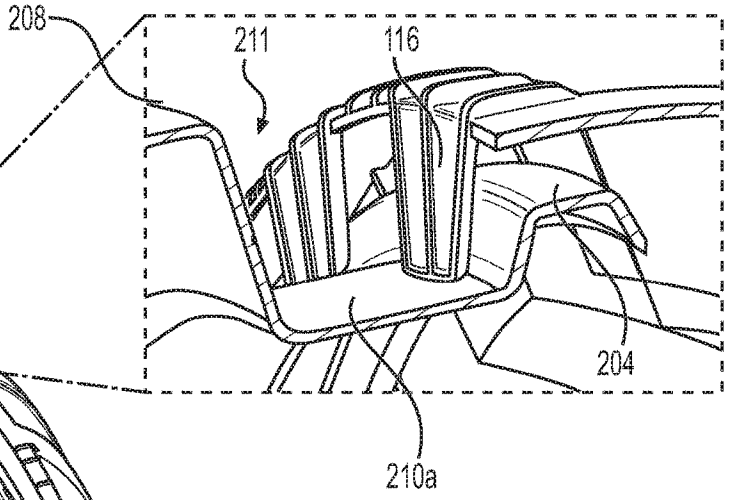
FIG. 2B is an exploded view of a fastening system that latches the end cap shown to the stormwater chamber body, according to a disclosed embodiment.
Figure 2A:
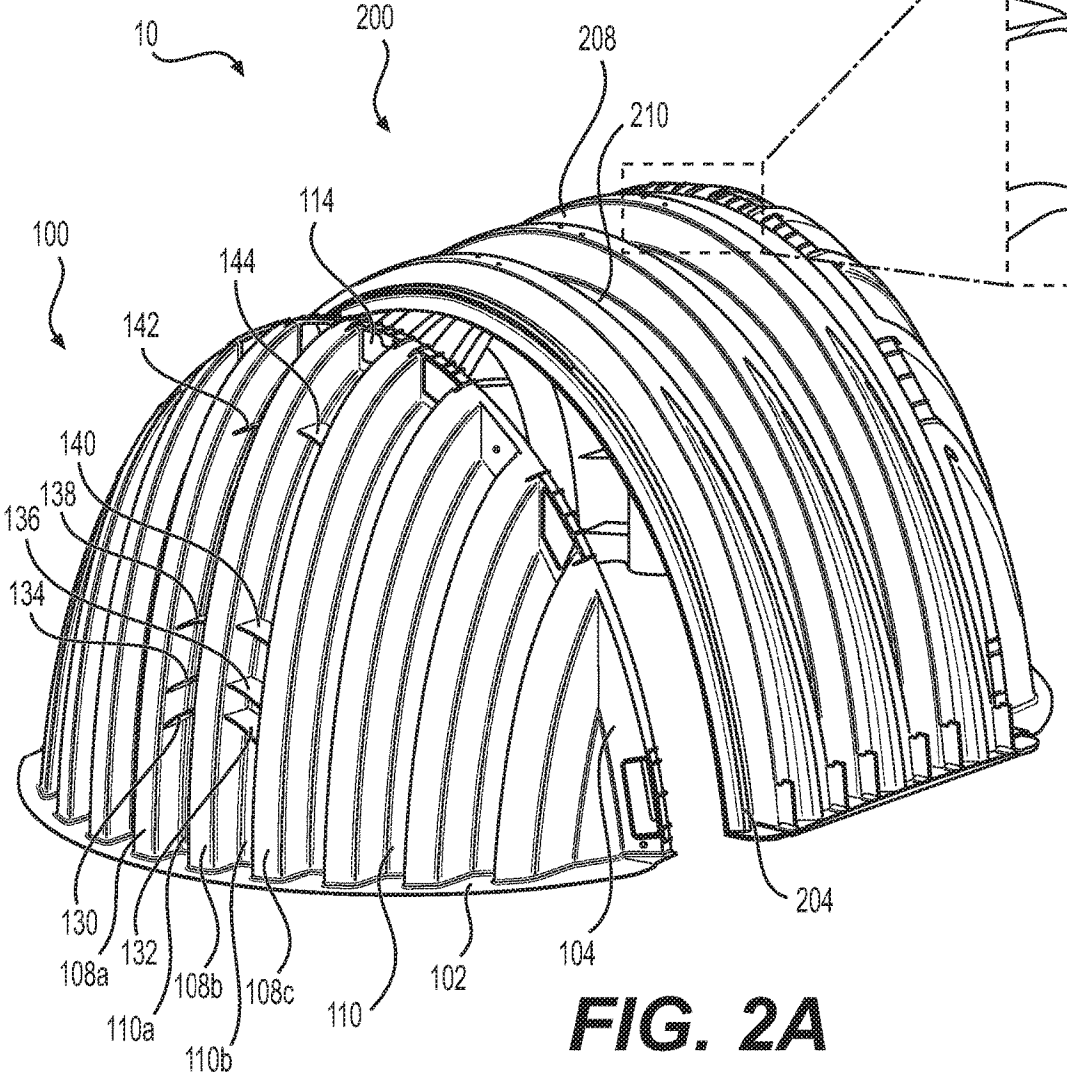
FIG. 2A is an exploded perspective view of the stormwater chamber shown in FIG. 1A with the end cap exploded from the stormwater chamber body, according to a disclosed embodiment.

FIG. 2B is an exploded view of FIG. 2A, illustrating a fastening system 211 for connecting the end cap 100 to the chamber body 200. In the illustrated embodiment, the fastening system 211 includes one or more teeth 116 configured to engage with one or more latch valley(s) 210*a*. That is, in the illustrated embodiment, to secure the end cap 100 to the chamber body 200, the end cap 100 is latched to the chamber body 200 such that the teeth 116 of the end cap 100 are disposed in latch valley(s) 210*a*. Latch valley(s) 210*a* may adjoin one or more latch ridges 204 that are disposed at each end of the length of the chamber body 200. In the illustrated embodiment, the bottom of teeth 116 contact the bottom surface of latch valley(s) 210*a*. However, in other embodiments, either the height of the teeth 116 or the height of the latch ridges 204 may be modified such that the bottoms of the teeth 116 do not contact the bottom of latch valley 210*a*. In other embodiments, the top of latch ridge 204 contacts the underside of frame exterior 104.

In one embodiment, the latch ridges 204 may be equal to the height of the peaks 208. However, in yet other embodiments, the height of the latch ridges 204 is less than the height of the peaks 208. For example, the height of the latch ridges 204 may be a third of the height of the peaks 208.

Further, in some embodiments, the latch ridge 204 may vary in relative size with respect to the teeth 116. For example, in one embodiment, the latch ridge 204 may be extended such that it is adjacent to the underside of the surface from which the teeth 116 extend. In such an embodiment, the space disposed between adjacent teeth 116 and the top of latch ridge 204 may be reduced or eliminated. In this embodiment, the foregoing feature may reduce or prevent the likelihood of materials, such as stone, from passing through the illustrated open space.

In some embodiments, the fastening system 211 may be subject to implementation-specific considerations. That is, the teeth 116, ridges 204, and valleys 210*a* may be replaced by any other suitable latching system for connecting the end cap 100 to the chamber body 200. For example, any suitable male end may be provided on one of the end cap 100 and the chamber body 200, while a mating female end may be provided on the other of the end cap 100 and the chamber body 200. For further example, in some embodiments, the male end may be provided on the chamber body 200 while the female end may be provided on the end cap 100.

Still further, in some embodiments, the fastening system 211 may include a semi-permanent or permanent connection between the end cap 100 and the chamber body 200. For example, the end cap 100 and the chamber body 200 may be coupled via welding, screws, gluing, taping, or any other suitable method of fixing the relative position between the end cap 100 and the chamber body 200. Further, in some embodiments, the fastening system 211 may include a latch-ridge structure in addition to another fastening mechanism, such as screws. In other embodiments, the fastening system 211 may include only a latch-ridge structure or only another latching mechanism (e.g., screws).

Figure 3:
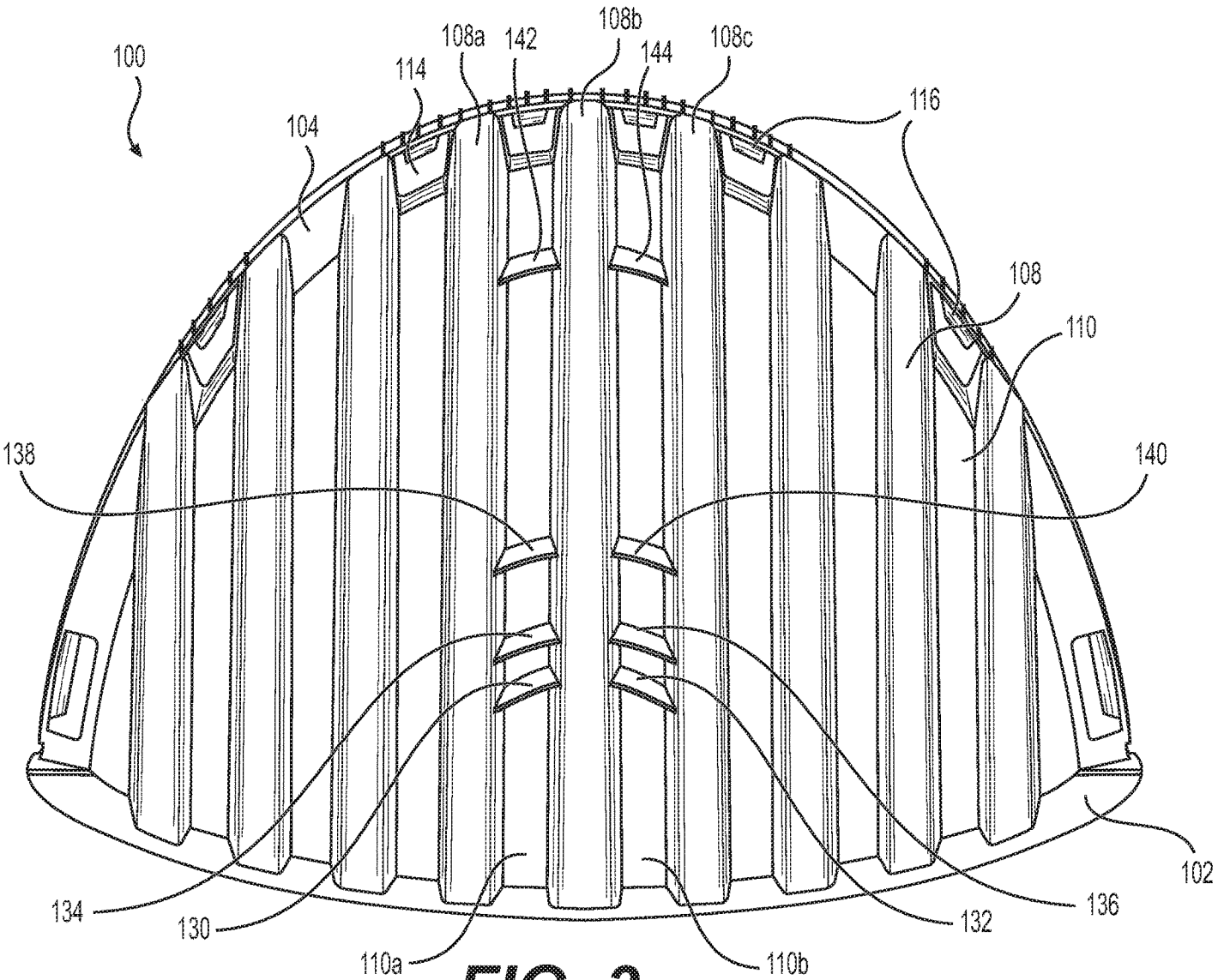
FIG. 3 is a front perspective view of an end cap, according to a disclosed embodiment.

FIG. 3 is a front perspective view of the exterior of the end cap 100. FIG. 3 illustrates openings 114 in the frame 104 of the end cap 100. In the illustrated embodiment, the teeth 116 of the end cap 100 extend outward from the frame 104, extending downward from the top of the frame 104, with each tooth generally corresponding to an opening 114. In this embodiment, the shape of a tooth 116 is substantially the same as the shape of the corresponding opening 114. For example, in the illustrated embodiment, the tooth includes four sides that mirror the four sides of the opening 114. In other embodiments, however, the shape of an opening 114 may be substantially different from its corresponding tooth 116. In yet another embodiment, there may be teeth 116 without corresponding openings 114.

The end cap 100 of the first embodiment discloses eight openings 114 and eight corresponding teeth 116. However, other embodiments may include more or less opening/tooth pairs depending on implementation-specific considerations. In other embodiments, the size and shape of the openings 114 and teeth 116 may be modified depending on implementation-specific concerns. For example, the size and shape of the openings 114 and corresponding teeth 116 may be altered when the size and shape of corresponding exterior valleys 110 are modified. In yet other embodiments, the size of the openings 114 closest to the base 102 may be increased to consume more of the frame exterior 104, or may be moved closer to the top of the end cap 100.

FIG. 3 illustrates each exterior rib 130, 132, 134, 136, 138, 140, 142, and 144 as being angled downward. In other embodiments, the angle and orientation of the exterior ribs may be changed depending on the planned size, shape, and placement of the pipe to be fitted into the end cap 100. For example, the ribs may not be curved. In some embodiments, one or more of the ribs may be linear or curvilinear. Moreover, they may be angled such that they are parallel to base 102.

In the illustrated embodiment, ribs 130 and 132 are two segments of a same first arc. Likewise, ribs 134 and 136 are shown as two segments of a same second arc. Ribs 138 and 140 are illustrated as two segments of a same third arc. Further, ribs 142 and 144 are illustrated as two segments of a same fourth arc. However, in other embodiments, other ribs could be disposed in other valleys 110 to provide additional segments to one or more of the first, second, third, and fourth arc.

In the illustrated embodiment, the thickness of each of the ribs is uniform. However, in other embodiments, one or more of the ribs could vary in thickness with respect to one or more of the remaining ribs. For example, ribs 142 and 144 could have a first thickness and ribs 138 and 140 could have a second, different, thickness. For further example, ribs 134 and 136 could have a third, different, thickness than ribs 130 and 132.

In yet other embodiments, exterior peak 108*b* could be eliminated and ribs 130 and 132 could be combined into a single connected rib. Likewise, ribs 134 and 136 could be combined into a single connected rib, ribs 138 and 140 could be combined into a single connected rib, and/or ribs 142 and 144 could be combined into a single rib. In other embodiments, only segments of the center peak 108*b* could be eliminated such that one or more pairs of ribs can be connected into a single rib. Further, in other embodiments, the width of the exterior peak 108*b* and/or the widths of the ribs could be modified such that the distance between each rib of a first pair of ribs could be different than the distance between each rib of a second pair of ribs. For example, the distance between ribs 130 and 132 could be different than the distance between ribs 134 and 136, which could be different than the distance between the ribs 138 and 140, which could be different than the distance between ribs 142 and 144.

Figure 4A:
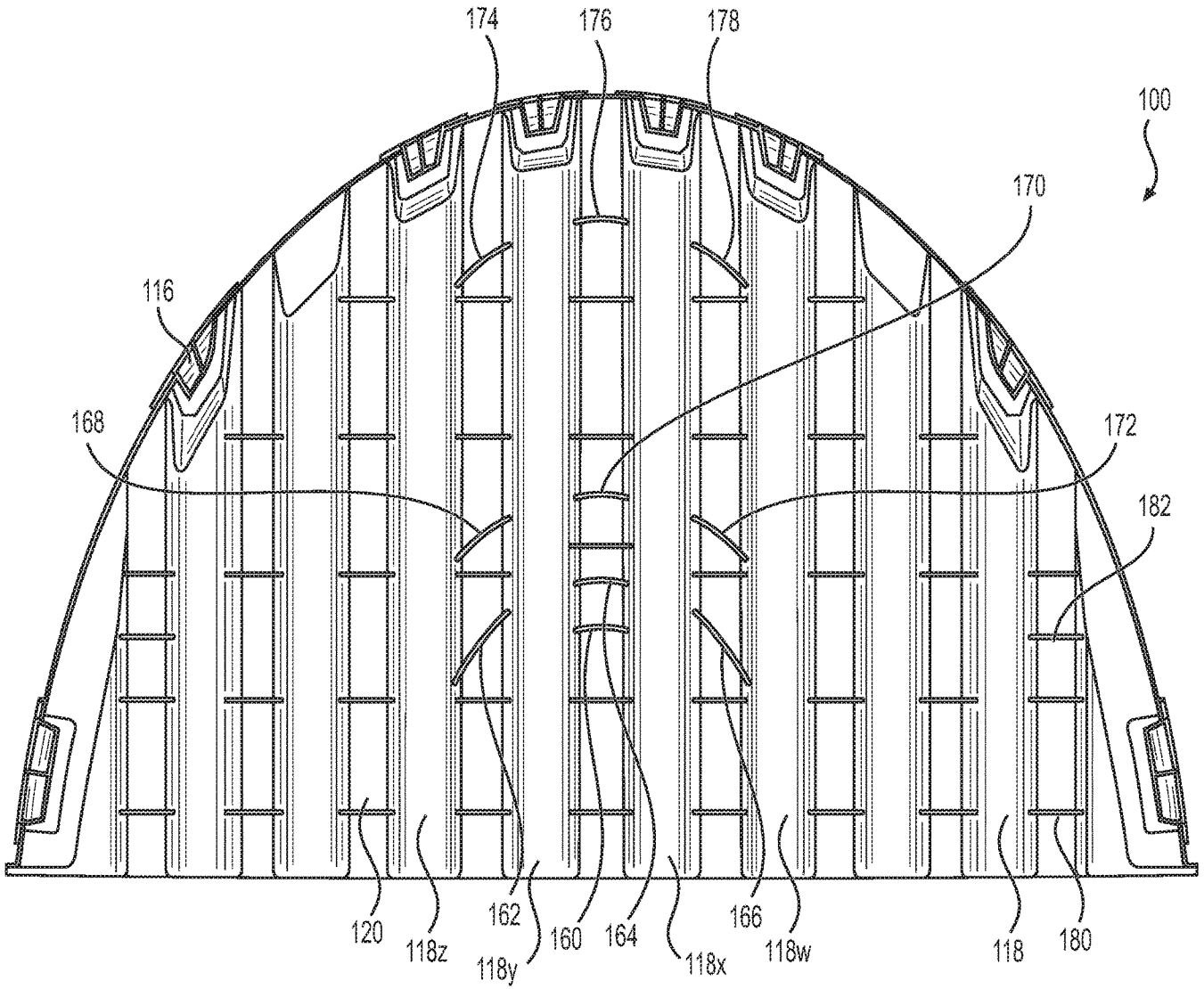
FIG. 4A is a rear perspective view of an end cap according to FIG. 1A, according to a disclosed embodiment.
Figure 4B:
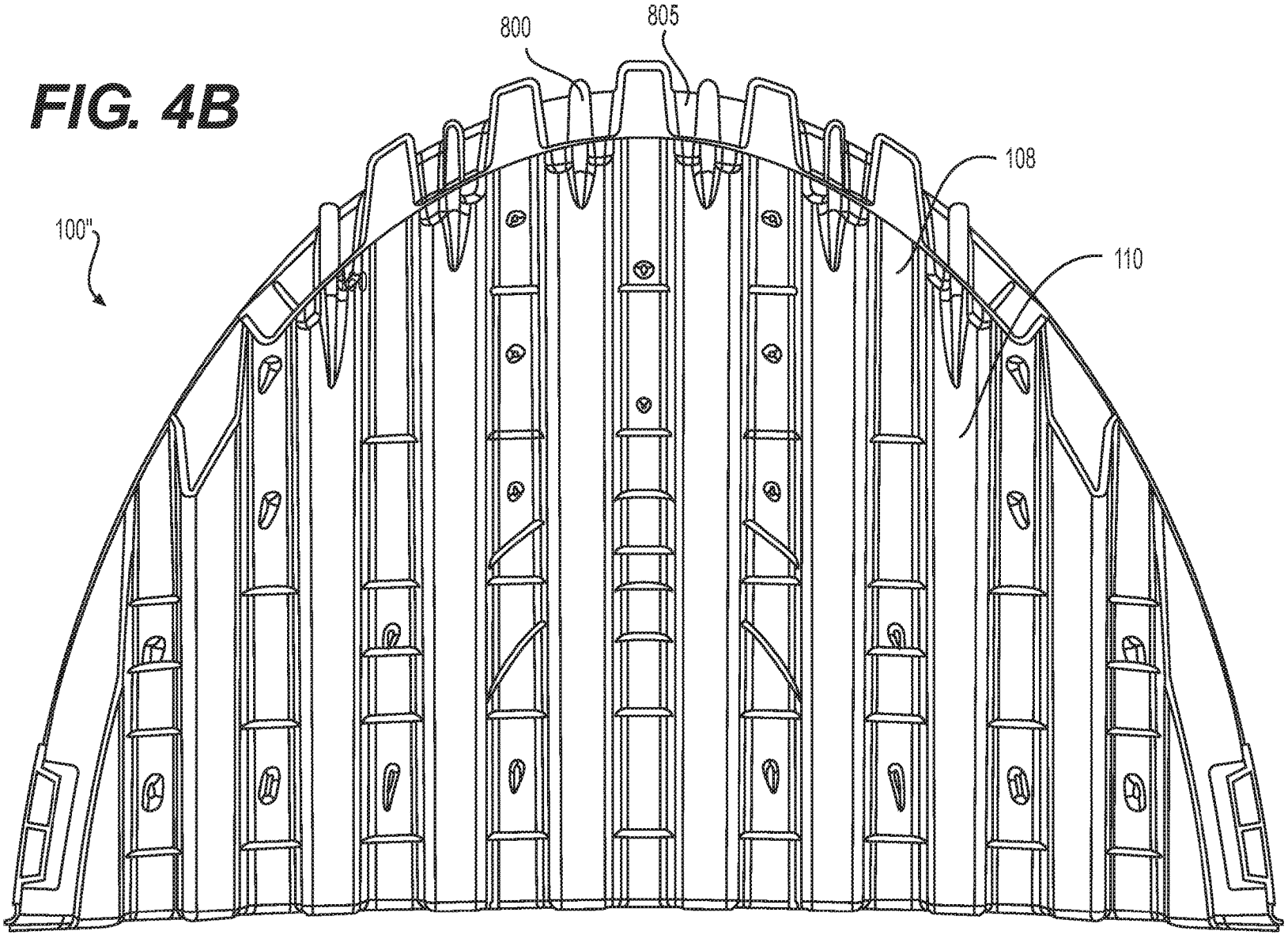
FIG. 4B is a rear perspective view of an end cap according to FIGS. 1D and 1E, according to a disclosed embodiment.
Figure 6:
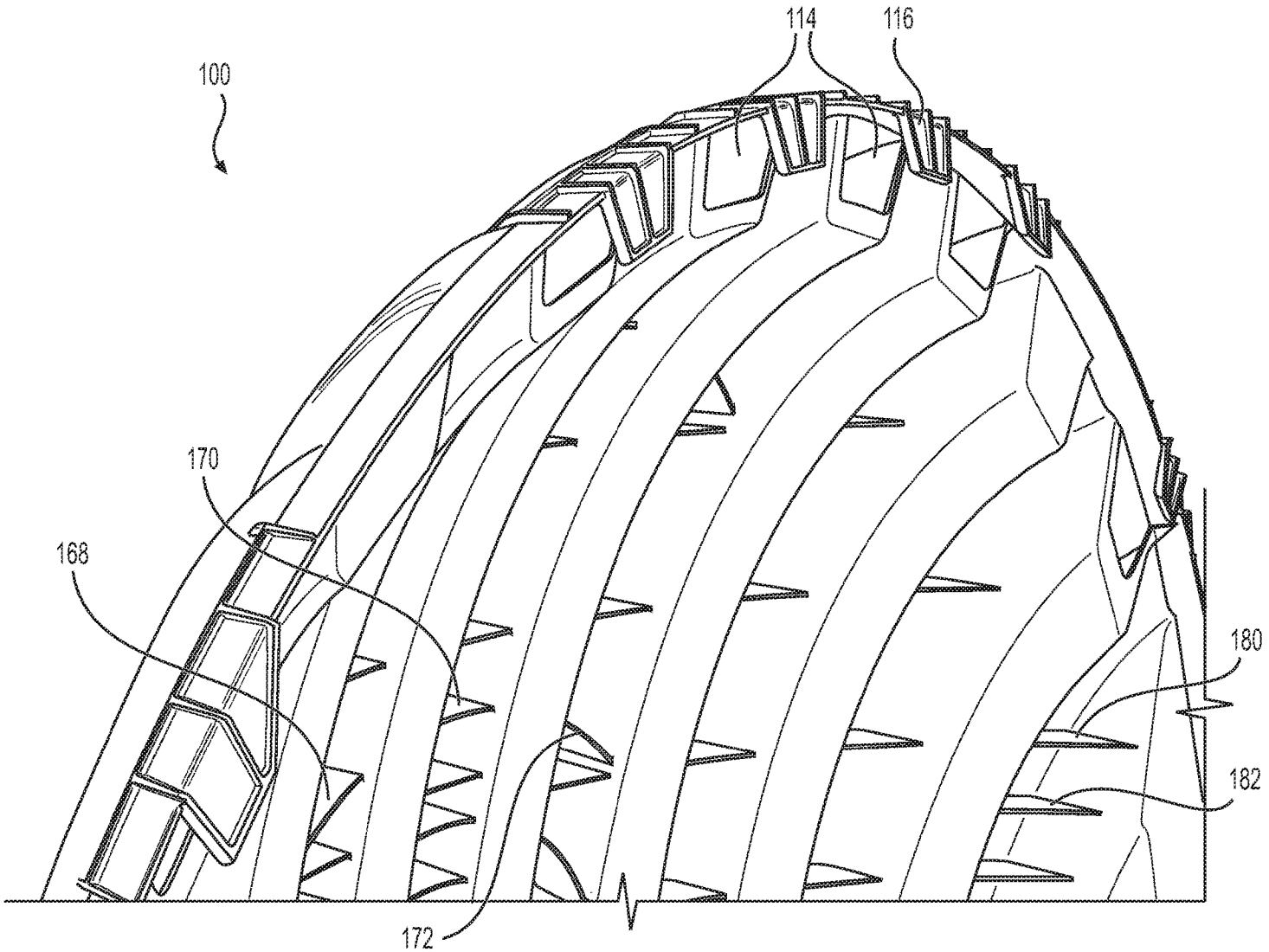
FIG. 6 is a cutaway perspective view of a portion of an end cap, according to a disclosed embodiment.

FIG. 4A is a rear perspective view of the end cap 100. FIG. 6 is a partial perspective view of the rear of end cap 100 taken at a different angle than FIG. 4A. As shown, the interior surface of the end cap 100 may be corrugated, with interior valleys 120 corresponding to the exterior peaks 108, and interior peaks 118 corresponding to exterior valleys 110. The interior surface of the end cap 100 may include one or more ribs, for example, in interior valleys 120. For example, in the illustrated embodiment, a plurality of interior ribs 160, 162, 164, 166, 168, 170, 172, 174, 176, 178, 180, and 182 are disposed in the interior valleys 120 to improve structural integrity of the end cap 100. In the illustrated embodiment, ribs 162, 168 and 174 are disposed in an interior valley between interior peaks 118*z* and 118*y*. Interior ribs 160, 164, 170, and 176 may be disposed in an interior valley between interior peaks 118*y* and 118*x*. Interior ribs 166, 172, and 178 may be disposed in an interior valley between interior peaks 118*x* and 118*w*.

In some embodiments, the interior rib 160 may correspond with exterior ribs 130 and 132 such that each of the ribs 130, 132, and 160 form a segment of a general shape. For example, the general shape (e.g., an arc of a circle) may be formed with the interior ribs may be separated from the exterior ribs by the side surfaces of the exterior valleys/interior peaks.

Further, the interior ribs 162, 164, and 166 may correspond with exterior ribs 134 and 136 such that each of ribs 134, 136, 162, 164, and 166 form a segment of a general shape (e.g., an arc of a circle), with the interior ribs being separated from the exterior ribs by the side surfaces of the exterior valleys 110/interior valleys 120. Similarly, the interior ribs 168, 170, and 172 may correspond with exterior ribs 138 and 140 such that each of ribs 138, 140, 168, 170, and 172 form a segment of a general shape (e.g., an arc of a circle), with the interior ribs being separated from the exterior ribs by the side surfaces of the exterior valleys 110/interior valleys 120. Likewise, the interior ribs 174, 176, and 178 may correspond with exterior ribs 142 and 144 such that each of ribs 142, 144, 174, 176, and 178 form a segment of a general shape (e.g., an arc of a circle), with the interior ribs being separated from the exterior ribs by the side surfaces of the exterior valleys 110/interior valleys 120.

In some embodiments, the general shapes formed by each set of ribs may be circles. The circles may have equal or different diameters. For example, the first circle (e.g., formed by ribs 130, 132, and 160) may have a first diameter (e.g., the smallest diameter); the second circle (e.g., formed by ribs 134, 136, 162, 164, 166) may have a second diameter (e.g., greater diameter than the first diameter); the third circle (e.g., formed by ribs 138, 140, 168, 170, and 172) may have a third diameter (e.g., greater than the second diameter); and/or the fourth circle (e.g., formed by ribs 142, 144, 174, 176, 178) may have a fourth diameter (e.g., greater than the third diameter). In other embodiments, however, the first, second, third, and fourth diameters may be the same or different than one another, depending on implementation-specific considerations. For example, the first, second, and third circles may be circles of equal diameter, whereas the fourth circle may have a greater or lesser diameter than the first circle.

In yet other embodiments, any or all of the first, second, third, and fourth shapes may be, for example, ovals, triangles, trapezoids, rhombuses, or any other suitable shape. The choice of the shape may be dependent on implementation-specific considerations, such as the size and shape of the pipe 300 and/or aperture 400.

The interior surface of end cap 100 also includes a plurality of interior ribs 180. In some embodiments, the plurality of ribs 180 may be provided in shapes, locations, etc. that contribute to the structural integrity of the end cap 100. In the illustrated embodiment, each interior valley 120 includes some of the interior ribs 180. However, the number of ribs 180 in each interior valley 120, as illustrated in FIG. 4A, is merely illustrative. In other embodiments, each interior valley 120 may include more or fewer ribs 180 than illustrated, depending on implementation-specific limitations.

In FIG. 4A, each interior rib 180 is illustrated as being oriented parallel to the base 102. In other embodiments, some or all of the interior ribs 180 may be non-parallel to the base 102. Moreover, in FIG. 4A, certain interior ribs 180 are horizontally aligned with other ribs 180 in other interior valleys 120. However, in other embodiments, each interior rib 180 may not align with other interior ribs 180 in other interior valleys 120. For example, interior ribs 180 may horizontally align with other interior ribs 180 in every other interior valley 120. Further, the interior ribs 180 may be oriented such that each rib 180 is oriented parallel to the base 102, but no rib is oriented inside the interior valleys 120 so as to be aligned with any interior rib 180 in another interior valley 120. In other embodiments, each interior rib 180 is oriented non-parallel to the base 102, and the interior ribs 180 may be oriented such that no rib is oriented inside the interior valleys 120 so as to be aligned with any interior rib 180 in another interior valley 120.

In one embodiment, each tooth 116 is disposed in line with an interior peak 118. The average width of a tooth 116 may be equal to the average width of its corresponding interior peak 118. However, in other embodiments, each tooth 116 may have a smaller average width than the average width of the corresponding interior peak 118. In another embodiment, each tooth 116 has an average width exceeding the average width of the corresponding interior peak 118 such that some portion of each tooth 116 extends to lie over an adjoining interior valley 120. In yet other embodiments, the average width of each tooth 116 may increase to the point where some of the teeth 116 are physically conjoined to form a larger tooth.

For example, three large teeth may be formed by physically conjoining the topmost four teeth 116 together to form a top tooth, physically conjoining the two leftmost teeth 116 to form a left tooth, and/or physically conjoining the rightmost two teeth 116 together to form a right tooth. In further embodiments, the topmost six teeth 116 may be physically conjoined to form the top tooth, while the leftmost and rightmost teeth illustrated in FIG. 4A may maintain substantially the same size as illustrated FIG. 4A.

In the embodiment illustrated in FIG. 4A, each tooth 116 has an average height less than an average height of the corresponding opening 114. However, in other embodiments, each tooth 116 may have an average height greater than or equal to the average height of the corresponding opening 114. In yet other embodiments, some teeth 116 may have an average height less than or equal to the average height of their corresponding openings 114, while other teeth 116 may have an average height greater than or equal to the average height of their corresponding openings 114. In some embodiments, each tooth 116 may have the same height, while in other embodiments, each tooth 116 may have a height different from each of the other teeth 116.

FIG. 4B is a rear perspective view of the end cap 100" of FIGS. 10 and 1E. As depicted in FIG. 4B, valley reinforcements 800 may extend over a top surface of end cap 100" and onto a rear surface 805. The rear surface 805 of end cap 100" may extend around all of part of the frame, e.g., 120 degrees around the frame or the like. Accordingly, the top surface, along with the front surface (not shown) and the rear surface 805 may form a recess configured to receive a latch ridge (e.g., ridge 204 of chamber body 200). As explained above, by using valley reinforcements 800 to replace teeth 116, end cap 100" may provide a load path from end cap 100" chamber body 200 and places some or all of the load on chamber body 200, reducing or preventing load on teeth 116.

Figure 4C:
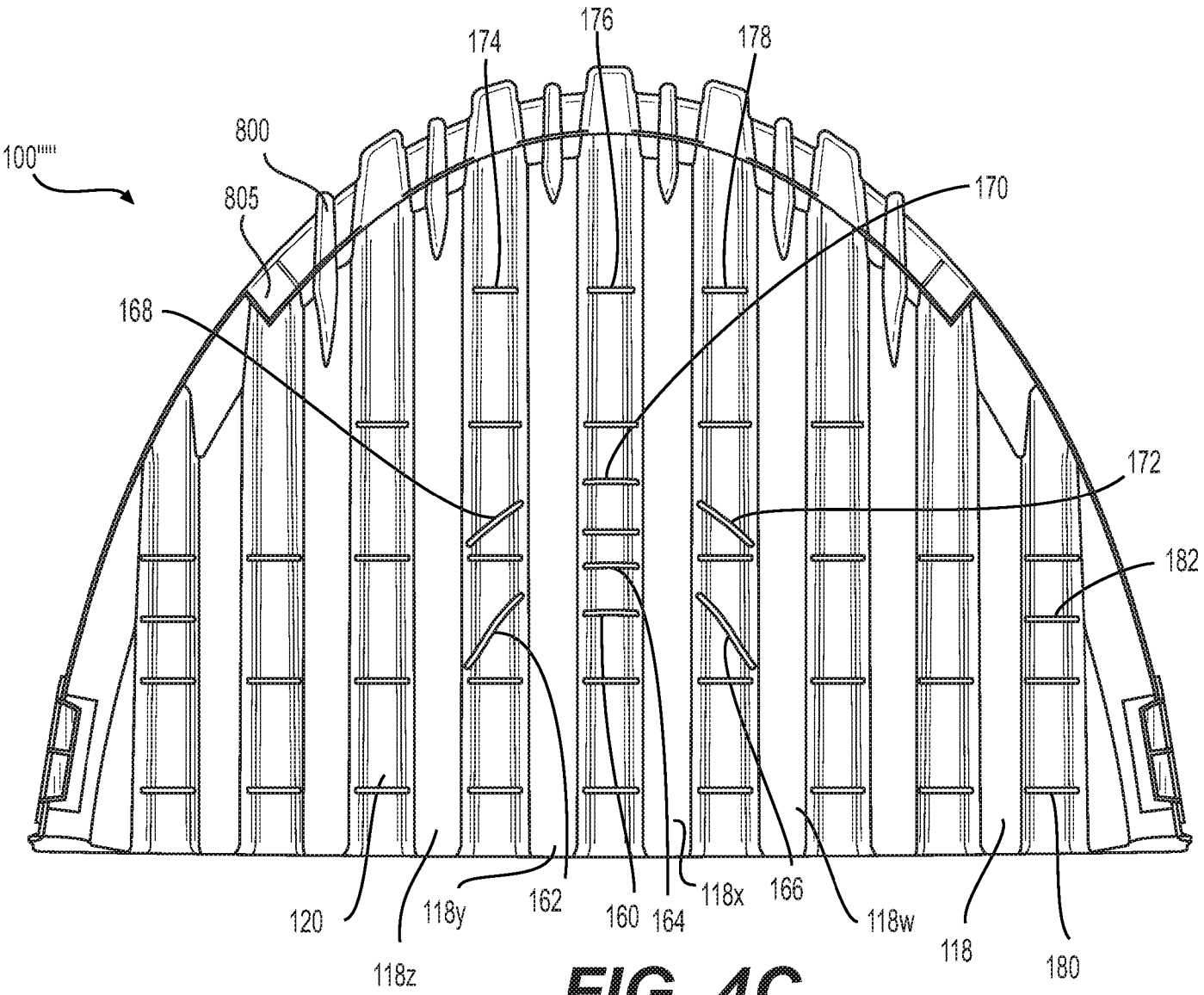
FIG. 4C is a rear perspective view of an end cap according to FIG. 1H, according to a disclosed embodiment.

FIG. 4C is a rear perspective view of the end cap 100 of FIG. 1H. As shown, the interior surface of the end cap 100 may be corrugated, with interior valleys 120 corresponding to the exterior peaks 108, interior peaks 118 corresponding to exterior valleys 110, and interior sub-corrugations 122 corresponding to exterior sub-corrugations 112. The interior surface of the end cap 100 may include one or more ribs, for example, in interior valleys 120. For example, in the illustrated embodiment, a plurality of interior ribs 160, 162, 164, 166, 168, 170, 172, 180, and 182 are disposed in the interior valleys 120 to improve structural integrity of the end cap 100.

Moreover, as further depicted in FIG. 4C, and similar to FIG. 4B, valley reinforcements 800 may extend over a top surface of end cap cap 100 and onto a rear surface 805. The rear surface 805 of end cap cap 100 may extend around all of part of the frame, e.g., 120 degrees around the frame or the like. Accordingly, the top surface, along with the front surface (not shown) and the rear surface 805 may form a recess configured to receive a latch ridge (e.g., ridge 204 of chamber body 200). As explained above, end cap cap 100 may use valley reinforcements 800 in combination with teeth 116 to latch to chamber body 200.

Figure 5:
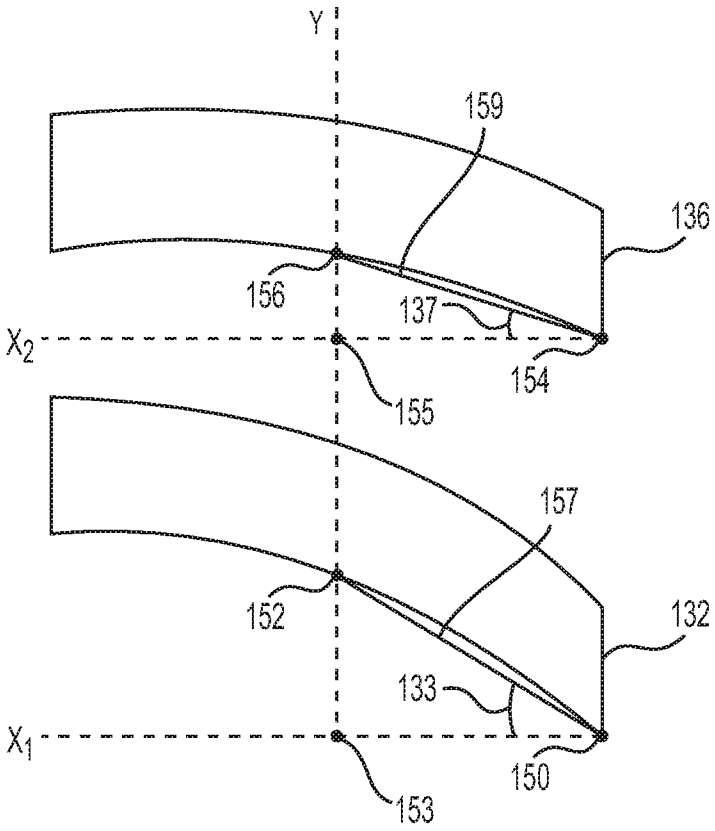
FIG. 5 is a schematic illustrating angles between ribs of an end cap, according to a disclosed embodiment.

FIG. 5 is a schematic illustrating an example relative positioning of two ribs. In the illustrated embodiment, ribs 132 and 136 are shown as illustrative examples. However, one of ordinary skill in the art would understand that similar principles could be applied to the other ribs of the end cap 100. As shown, the ribs 132 and 136 may be disposed at different angles, 133 and 137, relative to the end cap 100.

In the schematic of FIG. 5, three axes are illustrated. The y-axis is illustrated as a straight line. However, depending on the implementation, the y-axis may follow another shape, for example, the shape of end cap 100 proximate the ribs 132 and 136. For example, in the illustrated end cap 100 of FIG. 3A, the y-axis may follow the curvature of exterior valleys 110 (e.g., exterior valley 110*b*) from the base 102 to the frame exterior 104. In other embodiments, the y-axis may be substantially vertical, for example, if the end cap has little or no curvature.

The $x_1$-axis extends through the bottommost point 150 of the profile of rib 132 and point 153. Moreover, the $x_1$-axis may be parallel to base 102. Point 152 corresponds to the intersection point between the y-axis and the edge of rib 132. A first angle 133 is defined by the $x_1$ axis and a line 157 intersecting points 150 and 152. In other embodiments, for example, where the profile of rib 132 is not curved (e.g., a linear profile), the line intersecting points 150 and 152 may run along a bottom edge of the profile of rib 132.

Likewise, the $x_2$-axis extends through the bottommost point 154 of the profile of rib 136 and point 155. The $x_2$-axis may be parallel to base 102. Point 156 corresponds to the location where the y-axis intersects the edge of the rib 136. A second angle 137 is defined by the $x_2$-axis and a line 159 intersecting points 154 and 156. In other embodiments, for example, where the profile of rib 136 is not curved (e.g., a linear profile), the line intersecting points 154 and 156 may run along a bottom edge of the profile of rib 136.

In the illustrated embodiment, the first angle 133 is greater than the second angle 137. However, the relative quantities of the angles 133 and 137 may vary, depending on implementation-specific considerations. For example, in other embodiments the first angle 133 may be less than or equal to the second angle 137.

Further, although FIG. 5 depicts only the relationship between the first angle 133 under rib 132 and the second angle 137 under rib 136, the same relationship may exist between successive ribs from the bottom to the top of the end cap 100, such that the angle under rib 140 may be less than the second angle 137, and/or the angle under rib 144 may be less than the angle under rib 140. However, in other embodiments, each of these angles may be equal to one another, or ordered with different angle magnitudes, depending on implementation-specific concerns. Further, in some embodiments, the angles under ribs 144 and 140 may be approximately the same.

Moreover, the first and second angles 133 and 137 (and the corresponding angles under ribs 130 and 134) may be modified depending on the desired size and shape of the aperture 400 to be formed in the end cap 100. For example, in embodiments where the aperture 400 and pipe 300 have a smaller diameter than that illustrated in FIG. 4, the first and second angles 133 and 137 and the angles under ribs 130 and 134 may be increased. In embodiments where the aperture 400 and pipe 300 have a larger diameter than that illustrated in FIG. 4, the first and second angles 133 and 137 and the angles under ribs 130 and 134 may be decreased. In yet other embodiments, the angles under ribs 138, 140, 142 and 144 may be modified to alter the structural integrity of the end cap 100.

Further, it should be noted that each other exterior rib, 130, 134, 136, 138, 140, 142 and 144 has an angle situated between the same corresponding features of that rib (or reverse features for the ribs in valley 110*a*). Although these angles are not illustrated, one of ordinary skill in the art would understand that similar principles may apply.

In some embodiments, rib 130 may be a mirror image of rib 132 across exterior peak 108*b*, and the angle under rib 130 is equal to the first angle 133. However, in other embodiments, rib 130 may not be a mirror image of rib 132. Thus, the angle under rib 130 may be different than the first angle 133.

In some embodiments, rib 134 may be a mirror image of rib 136 across exterior peak 108*b*, and the angle under rib 134 may be equal to the second angle 137. However, in other embodiments, rib 134 may not be a mirror image of rib 136. Thus, the angle under rib 134 may be different than the second angle 137.

Further, although FIG. 5 depicts angles with reference to exteriorly positioned ribs on the end cap 100, similar principles may apply to one or more of the interior ribs of the end cap 100. That is, each interior rib 162, 166, 168, 172, 174 and 178 has an angle situated between the same corresponding features of that interior rib. For example, the angle under rib 166 may be greater than the angle under rib 172. Moreover, the angle under rib 178 may be less than or equal to the angle under rib 172. Further, in the illustrated embodiment, the ribs 162, 168 and 174 are mirror images of ribs 166, 172 and 178, respectively, such that the angles under ribs 162, 168 and 174 may be equal to the angles under the ribs 166, 172 and 178.

As with the angles under the exterior ribs, the angles under the interior ribs may be changed depending on implementation-specific concerns. For example, in embodiments where the pipe 300 and aperture 400 have a smaller diameter than that illustrated in FIG. 1A, the angles under the interior ribs 162 and 166 may be increased, and an arc radius of interior ribs 160 and 164 may be decreased. In embodiments where the pipe 300 and aperture 400 have a larger diameter than that illustrated in FIG. 1A, the angles under the interior ribs 162 and 166 may be decreased, and an arc radius of interior ribs 160 and 164 may be increased. Moreover, the angles under ribs 168, 172, 174 and 178 may be modified depending on implementation-specific concerns, for example, to increase the structural integrity of the end cap 100 when put under load.

In any of the embodiments described above, end caps of the present disclosure may be formed by a lie-flat injection molding apparatus performing a lie-flat injection molding process. In some embodiments, the end cap may be formed as a unitary structure. For example, the end cap may be formed all at once (e.g., from a single mold). Additionally or alternatively, end cap may be formed of the same material, formed during a single molding process, and/or without any additional construction post-molding.

It should be noted that the products and/or processes disclosed may be used in combination or separately. Additionally, exemplary embodiments are described with reference to the accompanying drawings. Wherever convenient, the same reference numbers are used throughout the drawings to refer to the same or like parts. While examples and features of disclosed principles are described herein, modifications, adaptations, and other implementations are possible without departing from the spirit and scope of the disclosed embodiments. It is intended that the prior detailed description be considered as exemplary only, with the true scope and spirit being indicated by the following claims.

The examples presented herein are for purposes of illustration, and not limitation. Further, the boundaries of the functional building blocks have been arbitrarily defined herein for the convenience of the description. Alternative boundaries can be defined so long as the specified functions and relationships thereof are appropriately performed. Alternatives (including equivalents, extensions, variations, deviations, etc., of those described herein) will be apparent to persons skilled in the relevant art(s) based on the teachings contained herein. Such alternatives fall within the scope and spirit of the disclosed embodiments. Also, the words "comprising," "having," "containing," and "including," and other similar forms are intended to be equivalent in meaning and be open ended in that an item or items following any one of these words is not meant to be an exhaustive listing of such item or items, or meant to be limited to only the listed item or items. It must also be noted that as used herein and in the appended claims, the singular forms "a," "an," and "the" include plural references unless the context clearly dictates otherwise.

What is claimed is:

1. A stormwater system, comprising:

an end cap configured to attach to an end of a chamber body to form a lateral wall of a stormwater chamber configured to contain stormwater and defined by the chamber body and the end cap, the end cap comprising:

a base;

a frame;

one or more corrugations defined by one or more sets of alternating peaks and valleys emanating from the base and up to a lateral surface of the frame, wherein the peaks and valleys have a curvature between the base and the frame, thereby forming a contoured outer surface of the end cap;

one or more ribs disposed in one or more of the valleys and configured to increase a resistance of the frame to bending; and one or more valley reinforcements disposed down a center axis of the valleys and running over a top surface of the frame.

2. The stormwater system of claim 1, wherein the one or more ribs are disposed on an exterior of the end cap.

3. The stormwater system of claim 1, wherein the one or more ribs are disposed on an interior of the end cap.

4. The stormwater system of claim 1, wherein the one or more valley reinforcements further run over a rear surface of the frame.

5. The stormwater system of claim 1, wherein the one or more valley reinforcements are tapered along at least one of a width or a height.

6. The stormwater system of claim 1, wherein at least one of the one or more ribs is disposed at an angle relative to a corresponding one of the peaks.

7. The stormwater system of claim 6, wherein the one or more ribs comprise a plurality of ribs, and at least two of the plurality of ribs are disposed at different angles relative to corresponding ones of the peaks.

8. The stormwater system of claim 6, wherein the one or more ribs comprise a plurality of ribs, and at least two of the plurality of ribs are disposed a same angle relative to corresponding ones of the peaks.

9. The stormwater system of claim 1, wherein the one or more ribs comprise a plurality of ribs, and more of the plurality of ribs are disposed in at least one of the valleys as compared with at least one other of the valleys.

10. The stormwater system of claim 9, wherein the at least one of the valleys is closer to a center axis of the frame end cap than the at least one other of the valleys.

11. The stormwater system of claim 1, wherein the one or more ribs comprise a plurality of ribs, and a same number of the plurality of ribs are disposed in at least two of the valleys.

12. The stormwater system of claim 1, further comprising:

one or more sub-corrugations disposed in the valleys.

13. The stormwater system of claim 12, wherein the one or more sub-corrugations are tapered along at least one of a width or a height.

14. The stormwater system of claim 12, wherein the one or more sub-corrugations comprise a plurality of sub-corrugations, and at least two of the plurality of sub-corrugations have different heights.

15. The stormwater system of claim 1, further comprising:

one or more guide lines disposed across the peaks and valleys such that, from at least one perspective, the one or more guide lines form one or more circular shapes.

16. The stormwater system of claim 1, wherein the end cap comprises one or more teeth configured to engage with one or more latch valleys disposed at an end of the chamber body.

17. The stormwater system of claim 1, further comprising a latching mechanism comprising one or more teeth configured to engage with one or more latch valleys disposed at an end of the chamber body.

18. A stormwater system, comprising:

an end cap configured to attach to an end of a chamber body to form a lateral wall of a stormwater chamber configured to contain stormwater and defined by the chamber body and the end cap, the end cap comprising:

a base;

a frame;

one or more corrugations defined by one or more sets of alternating peaks and valleys emanating from the base and up to a lateral surface of the frame, wherein the peaks and valleys have a curvature between the base and the frame, thereby forming a contoured outer surface of the end cap;

one or more ribs disposed in one or more of the valleys on an exterior of the end cap that faces away from the chamber body and configured to increase a resistance of the frame to bending; and one or more valley reinforcements in the valleys and running over a top surface of the frame, one or more additional ribs disposed on an interior of the end cap that faces towards the chamber body, wherein the one or more ribs are disposed at an angle relative to corresponding one or more of the peaks and the one or more ribs are positioned at different diameter positions based on dimensions of a pipe configured to fit into the end cap.

19. The stormwater system of claim 18, wherein the one or more ribs are disposed at greater angles relative to corresponding one or more of the peaks when a diameter of the pipe is smaller.

20. The stormwater system of claim 18, wherein the one or more additional ribs are disposed at greater angles relative to corresponding one or more of the peaks when a diameter of the pipe is smaller.

21. A stormwater system, comprising:

an end cap configured to attach to an end of a chamber body to form a lateral wall of a stormwater chamber configured to contain stormwater and defined by the chamber body and the end cap, the end cap comprising:

a base;

a frame;

one or more corrugations defined by one or more sets of alternating peaks and valleys emanating from the base and up to a lateral surface of the frame, wherein the peaks and valleys have a curvature between the base and the frame, thereby forming a contoured outer surface of the end cap;

one or more ribs disposed in one or more of the valleys; and one or more valley reinforcements disposed in the valleys and running over a top surface and onto a rear surface of the frame, wherein the top surface, a front surface, and a rear of the frame surround a recess configured to receive latch ridges from a stormwater chamber.

* * * * *